US006456808B1

(12) United States Patent
Chen et al.

(10) Patent No.: US 6,456,808 B1
(45) Date of Patent: Sep. 24, 2002

(54) SYSTEMS AND METHODS FOR REDUCING BANDING ARTIFACT IN ELECTROPHOTOGRAPHIC DEVICES USING DRUM VELOCITY CONTROL

(75) Inventors: Cheng-Lun Chen, Lafayette, IN (US); George Tsu-Chih Chiu, West Lafayette, IN (US)

(73) Assignees: Hewlett-Packard Company, Palo Alto, CA (US); Purdue Research Foundation, West LaFayette, IN (US)

( * ) Notice: Subject to any disclaimer, the term of this patent is extended or adjusted under 35 U.S.C. 154(b) by 0 days.

(21) Appl. No.: 09/802,193

(22) Filed: Mar. 7, 2001

(51) Int. Cl.[7] ..... G03G 15/00

(52) U.S. Cl. ..... 399/167; 399/78

(58) Field of Search ..... 399/40, 46, 76, 399/78, 167

(56) References Cited

U.S. PATENT DOCUMENTS 5,444,525 A * 8/1995 Takahashi et al. ..... 399/76
5,502,544 A * 3/1996 Carolan ..... 399/46
5,543,894 A * 8/1996 Carolan ..... 399/78
5,893,658 A * 4/1999 Kellie et al. ..... 399/40

OTHER PUBLICATIONS

Shaw, F. et al., "Discrete–Time Repetitive Control System Design Using the regeneration Spectrum", *Transactions of the ASME*, vol. 115 (1993) pp. 228–237.

Wulich, D. et al., "Image resolution limits resulting from mechnical vibrations", *Optical Engineering*, vol. (1987) pp. 529–533.

Bugner, D., "Review of Electrographic Printing", *Journal of Imaging Science*, vol. 35 (1991), pp. 377–387.

Burns, P. et al., "Analysis of image noise due to position errors in laser writer", *Applied Optics*, vol. 25 (1986), pp. 2158–2168.

Francis, B. et al., "The Internal Model Principle of Control Theory", *Automatica*, vol. 12 (1976), pp. 457–465.

Guo, L., "Reducing the Manufacturing Costs Associated with Hard Disk Drives—A New Disturbance Rejection Control Scheme", *IEEE*, vol. 2 (1997), pp. 77–85.

Guvenc, L., "Stability and Performance Robustness Analysis of Repetitive Control Systems Using Structured Singular Values", *Journal of Dynamic Systems, Measurement, and Control*, vol. 118 (1996), pp. 593–597.

Hara, S. et al., "Repetitive Control System: A new Type Servo System for Periodic Exogenous Signals", *IEEE*, vol. 33 (1988), pp. 659–668.

Hara, S. et al., "Synthesis of Repetitive Control Systems And Its Application", *IEEE* (1985), pp. 1387–1392.

(List continued on next page.)

*Primary Examiner*—Fred L Braun

(57) ABSTRACT

Systems and methods for reducing banding artifact in electrophotographic devices are provided. One such electrophotographic device uses a closed loop controller that receives a feedback signal from an encoder connected to the OPC drum to improve the rotational velocity control of the drum. The encoder provides the rotational position or angular velocity of the drum to the closed loop controller as the feedback signal. Optionally, the electrophotographic device uses a closed loop controller that incorporates a model of the human visual system, such as the human contrast sensitivity function, to help reduce noticeable banding artifacts. The human contrast sensitivity function incorporated into the primary control loop helps filter out low frequency and non-periodic drum rotational velocity fluctuations in producing banding artifacts. The electrophotographic device may also include a repetitive controller in a secondary control loop to help reduce the effect of periodic drum rotational velocity fluctuations in producing banding artifacts. Methods and other systems also are provided.

39 Claims, 13 Drawing Sheets

OTHER PUBLICATIONS

Hillerstrom, G., "Adaptive Suppression of Vibrations—A Repetitive Control Approach" *IEEE*, vol. 4 (1996), pp. 72–78.

Kawamoto, H., "Chatter Vibration of a Cleaner Blade in Electrophotography", Presented at IS&T's 11$^{th}$ International Congress on Advances in Non–Impact Printing Technologies (1995), pp. 8–13

Kawamoto, H. et al., "Vibration of Noise Induced by Electrostatic Force on a Contact Charger Roller of Electrophotography", Presented at IS&T's 48$^{th}$ Annual Conference (1995), pp. 477–480.

Lee, R. et al., "Repetitive Control Experiments for a CD Player", *Proceedings of the American Control Conference* (1998), pp. 2682–2684.

Lee, R. et al., "Robustness and Trade–offs in Repetitive Control", *Automatica*, vol. 34 (1998), pp. 889–896.

Loce, R. et al., "Modeling vinration–induced halftone banding in a xerographic laser printer", *Journal of Electronic Imaging*, vol. 4 (1995), pp. 48–61.

Ma, C., "Stability Robustness of Repetitive Control Systems With Zero Phase Compensation", *Transaction of the ASME*, vol. 112 (1990), pp. 320–324.

Manayathara, T. et al., "Rejection of Unknown Periodic Load Disturbances in Continuous Steel Casting Process Using Learning Control Approach", *IEEE* , vol. 4 (1996), pp. 259–265.

Mannos, J. et al., "The Effects of a Vasual Fidelity Criterion on the Encoding of Images", *IEEE*, vol. IT–20 (1974), pp. 525–536.

Melnychuck, P. et al., "Fourier spectra of digital halftone images containing dot–position errors", *J. Opt. Soc. Am.*, vol. 5 (1988), pp. 1328–1338.

Miller, T., "Brushless Permanent–Magnet and Reluctance Motor Drives", *Clarendon Press* (1998), pp. 54–85.

Moon, J. et al., "Repetitive Control for the Track–Following Servo System of an Optical Disk Drive", *IEEE*, vol. 6 (1998), pp. 663–670.

Murai, Y. et al., "Torque Ripple Improvement for Brushless DC Miniature Motors", *IEEE*, vol. 25 (1989), pp. 441–450.

Nasanen, R., "Visibility of Halftone Dot Textures", *IEEE*, vol. SMC–14 (1984), pp. 920–924.

Schaffert, R., "Electrophotography" *John Wiley & Sons* (1975), pp. 27–93.

Schubert, P., "Periodic image artifacts from continuous–tone laser scanners", *Applied Optics*, vol., 25 (1986), pp. 3880–3884.

Srinivasan, K. et al., "Analysis and Design of Repetitive Control Systems Using The Regeneration Spectrum", *Transactions of the ASME*, vol. 113 (1991), pp. 217–222.

Tomizuka, M. et al., "Analysis and Synthesis of Discrete–Time Repetitive Controllers", *Journal of Dynamic Systems, Measurement, and Control*, vol. 111 (1989), pp. 353–358.

Weiss, G. et al., Repetitive control of MIMO systems using $H^x$ design[1], *Elsevier Science Ltd.* (1999), pp. 1185–1199.

Yamada, M. et al., "Design of Discrete–Time Repetitive Control System for Pole Placement and Application", *IEEE*, vol. 4 (1999), pp. 110–118.

* cited by examiner

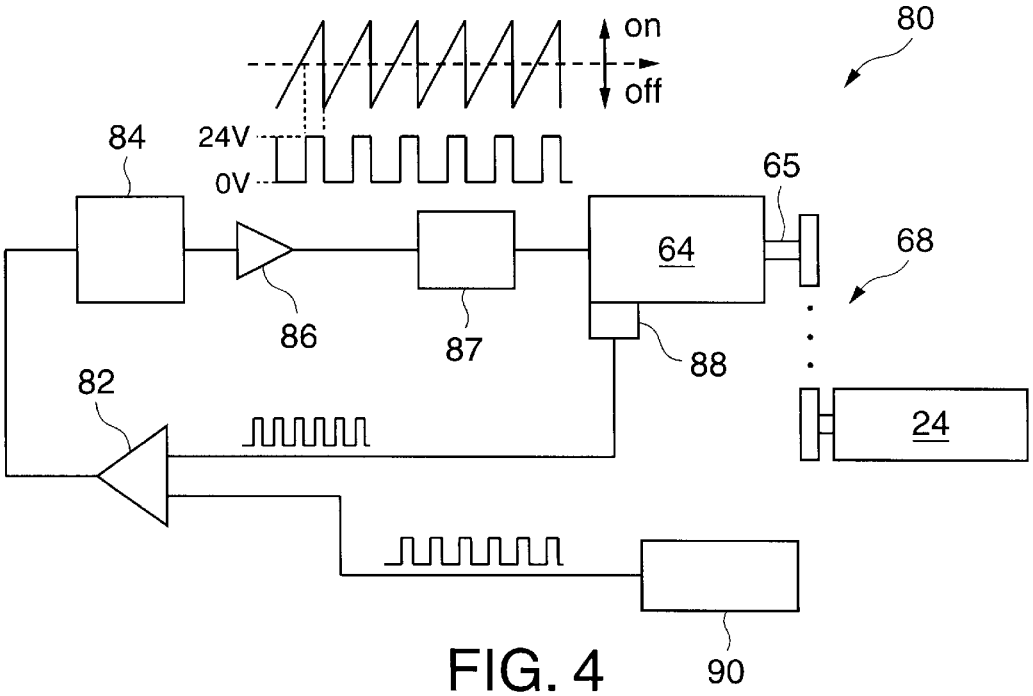
FIG. 4
(Conventional)
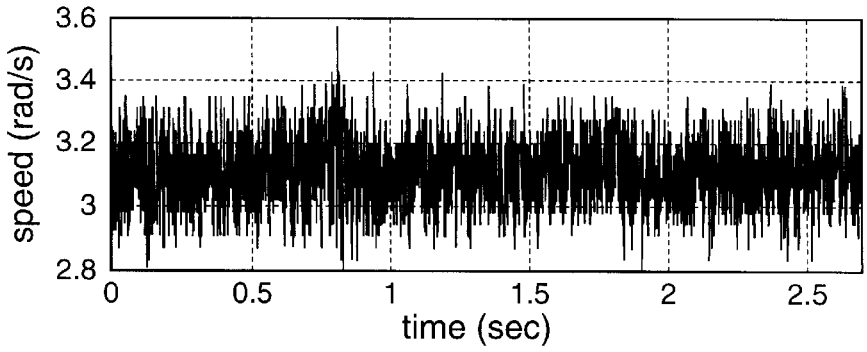
FIG. 5A
(Conventional)
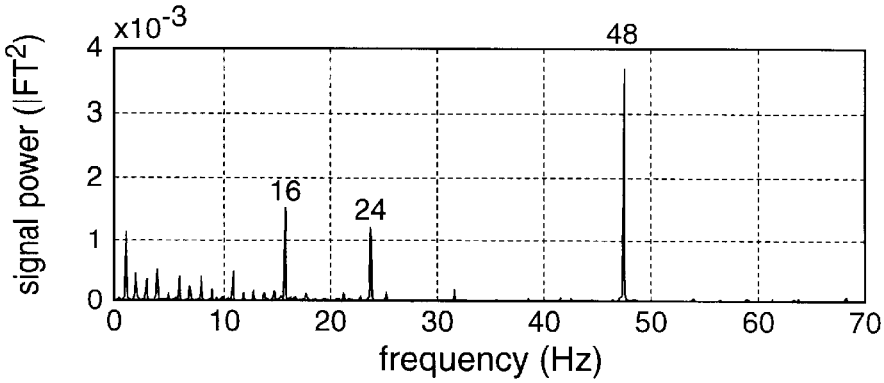
FIG. 5B
(Conventional)

| FIG. 8A | FIG. 8B |
|---|---|

SYSTEMS AND METHODS FOR REDUCING BANDING ARTIFACT IN ELECTROPHOTOGRAPHIC DEVICES USING DRUM VELOCITY CONTROL

CROSS-REFERENCE TO CD-R APPENDIX

An Appendix containing a computer program listing is submitted on a compact disk, which is herein incorporated by reference in its entirety. The total number of compact disks, including duplicates, is two. The files contained on the compact disk include, ctrl_r~1.h (1.5 KB, Mar. 1, 2001), ctrl_r~1.reg (4.97 KB, Mar. 1, 2001), ctrl raw.c (7.41 KB, Mar. 1, 2001), ctrl_raw.h (7.07 KB, Mar. 1, 2001), and ctrl_raw.prm (10.5 KB, Mar. 1, 2001).

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to electrophotographic devices, such as laser printers, and in particular to the reduction of banding artifacts produced by electrophotographic printers.

BACKGROUND

Electrophotography (EP) is the basic imaging process used in paper copiers and laser printers. Conventional EP devices include an organic photoconductive (OPC) drum that rotates at a constant angular velocity. As the OPC drum rotates it is electrostatically charged, and a latent image is exposed line by line onto the OPC drum using a scanning laser, e.g., using a rotating polygon mirror. The latent image is then developed by electrostatically adhering toner particles to the OPC drum. The developed image is then transferred from the OPC drum to the output media (paper). The toner image on the paper is then fused to the paper to make the image on the paper permanent. The surface of the OPC drum is then cleaned to remove any residual toner on the surface of the OPC drum.

Typically, the EP device drives the rotating polygon mirror and the OPC drum using two brushless DC (BLDC) motors. The rotational velocity of the rotating polygon mirror can be maintained very precisely using a BLDC motor, because there is no external loading except for the mirror itself. The main drive motor for driving the OPC drum, on the other hand, has a substantial amount of external loading, because the main drive motor typically drives all the auxiliary rollers and transports the paper, particularly in a low cost EP device. The main drive motor typically drives the auxiliary rollers and paper transport through a series of gear trains. With the additional loading, as well as periodic disturbances due to imperfections in the series of gear trains, the rotational velocity of the OPC drum is difficult to control resulting in velocity perturbations.

The OPC drum velocity perturbations cause scan line spacing variation in the printed image. The scan line spacing variation is a significant contributor of artifacts in EP processes. For example, halftone banding caused by scan line spacing variation is one of the most visible and undesirable artifacts, appearing as light and dark streaks across a printed page perpendicular to the process direction. Thus, to reduce halftone banding artifacts, the OPC drum velocity variation should be reduced.

Recent improvements to EP devices to reduce halftone banding, however, have been focused on manufacturing more precise gears and better mountings to reduce or eliminate the velocity perturbations. Unfortunately, improved mechanical precision does not completely reduce banding artifacts. Moreover, mechanical components, such as gears, tend to wear with use. Consequently, as the EP device is used and the mechanical components wear, image quality due to banding artifacts will deteriorate.

Thus, what is needed is improved regulation of the OPC drum rotational velocity under various loading uncertainty and process variations, e.g., mechanical component manufacturing tolerance and wear, to improve EP process stability and reduce the appearance of banding artifacts.

SUMMARY

An electrophotographic device uses a closed loop controller that receives a feedback signal from an encoder connected to the OPC drum to improve the rotational velocity control of the drum. The encoder provides the rotational position or angular velocity of the drum to the closed loop controller as the feedback signal. The electrophotographic device includes a rotating drum, such as an OPC drum, a motor that drives the rotating drum, the encoder that is connected to the rotating drum, and a controller that controls the motor based on the feedback signal from the encoder. In another aspect of the invention, a method of controlling the velocity of the drum to reduce banding artifacts includes providing a control signal to the motor that drives the drum, monitoring the position and/or angular velocity of the drum, and varying the control signal to the motor based on the position and/or the angular velocity of the drum.

In another aspect of the present invention, the electrophotographic device includes a closed-loop controller that controls the angular velocity of the monitor that drives the drum, wherein the closed-loop controller incorporates a model of the human visual system, such as the human contrast sensitivity function. The human contrast sensitivity function may be incorporated into the controller, e.g., in a digital signal processor or microprocessor, that helps filter out low frequency and non-periodic drum rotational velocity fluctuations that contribute to banding artifacts. In another aspect of the invention, a method of controlling the velocity of a rotating drum in the electrophotographic device to reduce banding artifacts includes providing a command signal, receiving a feedback signal of at least one of the position and angular velocity of the rotating drum, and using the command signal and the feedback signal in a primary control loop incorporating the human visual system to produce a control signal for a motor that drives the rotating drum. The command signal and feedback signal may be used to produce an error signal, which is filtered to at least partially filter out low frequency and non-periodic drum rotational velocity fluctuations to approximate the human visual system. The control signal provided to the motor is based on the filtered error signal.

In another aspect of the present invention, a closed loop controller for an electrophotographic device is designed to reduce banding artifacts by modeling an open loop transfer function for the electrophotographic device, and using loop shaping to design the closed loop controller with respect to said open loop transfer function to incorporate the human visual system model. The loop shaping techniques may be used to produce a desired frequency response in the electrophotographic device by modifying the open loop transfer function.

In another aspect of the present invention, the electrophotographic device may also include a repetitive controller in a secondary control loop to help reduce the effect of periodic drum rotational velocity fluctuations that contribute to banding artifacts. The repetitive controller may be used with a primary control loop that incorporates the human visual system or with any other control loop. The electrophotographic device, thus, includes a rotating drum, a motor that drives the rotation of the drum, an encoder coupled to the drum that monitors at least one of the position and angular velocity of the rotating drum, and a closed-loop controller coupled to the motor and the encoder. The repetitive controller is coupled to the closed-loop controller in a secondary control loop, and is designed to compensate for the periodic disturbances in the rotation of the rotating drum. In another aspect of the present invention, a method of controlling the velocity of the rotating drum in an electrophotographic device to reduce banding artifacts includes using a primary controller in a primary control loop to control the rotational velocity of a rotating drum in the electrophotographic device, and using a repetitive controller in a secondary control loop to control the primary controller to reduce the effect of periodic drum rotational velocity fluctuations in producing banding artifacts.

BRIEF DESCRIPTION OF THE DRAWINGS

FIG. 4 shows a typical PLL control circuit used to control a motor driving the OPC drum.

FIGS. 5A and 5B are graphs respectively showing the measured velocity of an OPC drum in a conventional EP device and the corresponding power spectrum.

DETAILED DESCRIPTION

Electrophotography (EP) process stability is improved, in accordance with one aspect of the present invention, through the use of a closed-loop OPC drum velocity regulation controller that reduces the sensitivity of the OPC drum velocity regulation to both periodic and non-periodic disturbances and manufacturing uncertainties. In one aspect of the present invention, the proposed OPC drum velocity controller uses the OPC drum angular position from an encoder in a feedback loop.

In another aspect of the present invention, the OPC drum rotational velocity is regulated using a closed loop controller that incorporates a human visual system (HVS) model into the primary loop to eliminate low frequency and non-periodic OPC drum rotational velocity fluctuations. The HVS based loop design advantageously addresses the subjective evaluation of the printing process by incorporating human visual perception into EP process control. The HVS based controller also helps to eliminate DC drifts as well as provide robustness to the OPC drum velocity control loop.

In another aspect of the present invention, the controller for regulating the OPC drum rotational velocity additionally uses an internal model based repetitive controller to reduce the effect of periodic velocity fluctuations. With the removal of the DC components of the disturbances by the HVS based controller, the nominal (mean) value of the OPC drum angular velocity is constant. Thus, the fundamental and harmonic frequencies of any remaining periodic disturbances will be stationary and the repetitive controller can be applied directly without modification.

Thus, in accordance with an aspect of the present invention, the EP process is improved by not only using a two level OPC drum velocity control strategy to reduce the process sensitivity to periodic and non-periodic disturbances, but the HVS is incorporated into the EP process control.

Figure 1:
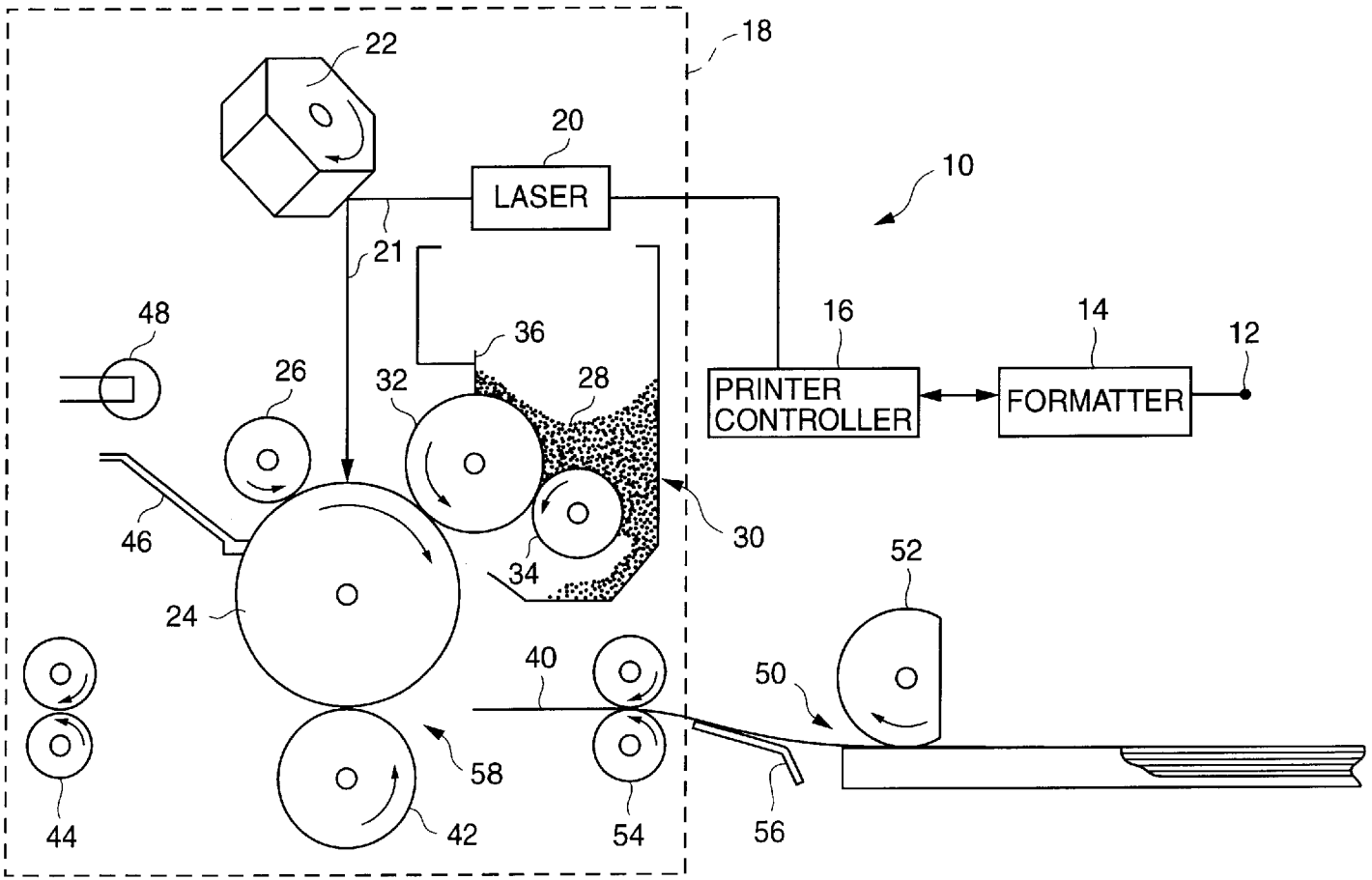
FIG. 1 schematically depicts the basic components of a laser printer with which the present invention may be used.

FIG. 1 schematically depicts the basic components of a laser printer, designated by reference number 10, with which the present invention may be used. The present invention is equally well suited for use in a variety of electrophotographic printing devices, including printers, copiers and facsimile machines, and is not limited to the laser printer embodiment shown in the figures and described below. In as much as the art of electrophotographic laser printing is well known, the basic components of laser printer 10 are shown schematically and their operation described only briefly.

In general, a computer transmits data representing a print image to input port 12 of printer 10. This data is analyzed in formatter 14, which typically consists of a microprocessor and related programmable memory and page buffer. Formatter 14 formulates and stores an electronic representation of each page to be printed. Once a page has been formatted, it is transmitted to the page buffer. The page buffer breaks the electronic page into a series of lines or "strips" one dot wide. This strip of data is then sent to a printer controller 16. Controller 16, which also includes a microprocessor and related programmable memory, directs and manages the operations of print engine 18. Each strip of data is used to modulate the light beam produced by laser 20 such that the beam of light "carries" the data. The light beam is reflected off a multifaceted spinning mirror 22. As each facet of mirror 22 spins through the light beam, if reflects or "scans" the beam across the surface of the organic photoconductive (OPC) dram 24. OPC drum 24 rotates about a motor-driven shaft such that it advances just enough that each successive scan of the light beam is recorded on drum 24 immediately after the previous scan. In this manner, each strip of data from the page buffer is recorded on photoconductive drum 24 as a line one after the other to reproduce the page on the drum.

Charging roller 26 charges OPC drum 24 to a relatively high substantially uniform negative (or positive) polarity at its surface. A corona type charge generating device may be used in place of the charging roller. For discharge area development (DAD), such as that used in laser printers, the areas on the fully charged OPC drum 24 exposed to light beam 21 from laser 20 represent the desired print image. The exposed areas of OPC drum 24 are partially or fully discharged, depending on the intensity of light beam 21 and the duration of exposure. The unexposed background areas of OPC drum 24 remain fully charged. This process creates a latent electrostatic image on conductive drum 24. For charge area development (CAD), such as that used in photocopiers, the background areas on the fully drum 24 are exposed to the light. The unexposed areas of the drum represent the desired print image. For DAD development processes, the toner particles are charged to the same polarity as the OPC drum. For CAD development processes, the toner particles are charged to a polarity opposite that of the OPC drum.

Toner particles 28 are triboelectrically charged in toner application unit 30 to the same negative (or positive) polarity as OPC drum 24. Toner application unit 30 includes a developer roller 32 positioned adjacent to a charge applicator roller 34 and metering blade 36. Developer roller 32 is electrically biased to repel the charged toner particles 28 to the discharged image areas on OPC drum 24. The fully charged background areas also repel toner particles 28 onto the discharged image areas. In this way, the toner is transferred to OPC drum 24 to form the developed toner images 38.

Toner images 38 are transferred from OPC drum 24 onto paper 40 as paper 40 passes between OPC drum 24 and transfer roller 42. Transfer roller 42 is electrically biased to impart a relatively strong positive charge to the back side of paper 42 as it passes by OPC drum 24. The positive charge attracts the negatively charged toner and pulls it from OPC drum 24 to form the image on paper 42. The toner is then fused to paper 40 as the paper passes between heated fusing rollers 44. OPC drum 24 is cleaned of excess toner with cleaning blade 46. Each sheet of paper 40 is pulled into the pick/feed area 50 by feed roller 52. As the leading edge of paper 40 moves through pick/feed area 50, it is engaged between a pair of registration rollers 54. Ramp 56 helps guide paper 40 into registration rollers 54. Registration rollers 54 advance paper 40 fully into image area 58 until it is engaged between drum 24 and transfer roller 42 and toner is applied as described above.

Figure 2:
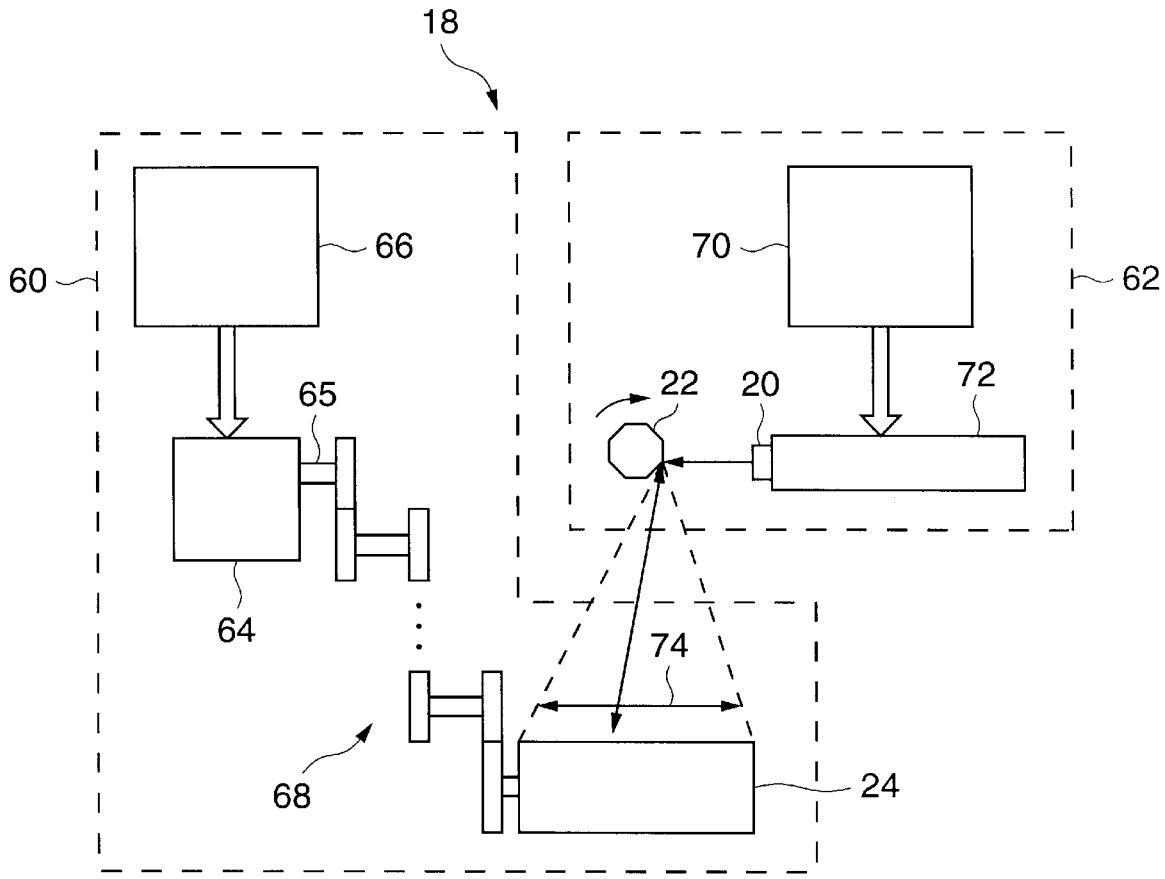
FIG. 2 schematically depicts another view of the print engine.

FIG. 2 schematically depicts another view of the print engine 18, which includes two subsystems: the mechanical drive 60 and the optics 62. The first subsystem, i.e., the mechanical drive 60, includes the main drive brushless DC (BLDC) motor 64, the motor control circuit 66, the gear train 68, and the OPC drum 24. The mechanical drive 60 provides torque to maintain a constant angular velocity of the OPC drum 24. The motor control circuit 66 controls the velocity of the motor 64 by adjusting the amount of current flowing through the armature windings of the motor. The motor shaft 65 drives the gear train 68, which connects to the OPC drum 24 through a series of gears. The gears in gear train 68 provide the desired velocity reduction from the motor 64 to the OPC drum 24. The gear train 68 may also connects to various other rollers, such as charging roller 26, transfer roller 42, feed rollers 52 and 54, and fusing rollers 44, as well as developer roller 32 and charge applicator roller 34 in the toner application unit 30.

The second subsystem, i.e., the optics 62, includes the image processing unit 70 (which includes, e.g., printer controller 16 and formatter 14 shown in FIG. 1), laser control unit 72, the laser 20, and the polygon mirror 22, which deflects the laser beam from laser 20 to the OPC drum 24 in scanning direction indicated by arrow 74. The optical subsystem 62 controls the intensity of the laser and the position of incidence of the laser on OPC drum 24. The laser control unit 72 generates pulses which control the on-off of the laser 20, according to the image that is to be exposed on the OPC drum.

During exposure, a laser beam scans, line by line, rapidly across the OPC drum 24 in the scanning direction. The timing of the laser scan is based on the rotational speed of the rotating polygon mirror 22. For a polygon mirror 22 spinning at a constant angular velocity, the OPC drum 24 should have a constant angular velocity to maintain constant pitch between scan lines in the process direction.

Figure 3:
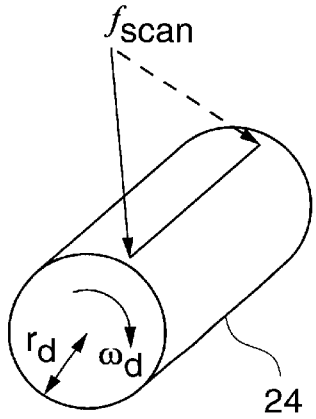
FIG. 3 illustrates an OPC drum.

The process resolution of an EP device is defined as dots per inch (DPI) perpendicular to the laser beam scanning direction 74. As shown in FIG. 3, if the laser beam scans across the OPC drum 24 at a scanning frequency of $f_{SCAN}$ Hz and the OPC drum 24, with radius $r_d$ inches, rotates at a velocity of $\omega_d$ radians per second, the process resolution is defined as:

$$DPI = \frac{f_{SCAN}}{\omega_d \times r_d} \qquad \text{eq. 1}$$

where DPI is the EP process resolution in dots per inch. Thus, for example, where the scanning frequency is 1.11 kHz and the drum diameter is measured to be 1.181 inches, the desired drum velocity for 600 DPI should be $\omega=1111/600\times2/1.181=3.13576$ rad/s.

As discussed above, during exposure, the laser beam will scan line by line rapidly across the OPC drum 24 to form the latent image. The pitch between two adjacent lines is defined as the scan line spacing or line spacing. Line spacing is an important factor that affects image (print) quality. Thus, in order to obtain good image quality, it is desirable to have consistent line spacing across the entire page. A 600 DPI engine, for example, ideally has a line spacing of 1/600 inch. Banding is a phenomenon that occurs due to uneven line spacing between scanning lines. Banding artifacts degrade the printing quality, appearing as alternate light and dark streaks on the printout and degrading the printing quality.

Because line spacing is defined as the pitch between two adjacent scan lines in the process direction, i.e., the rotating direction of the OPC drum 24, line spacing can be represented as follows:

$$\Delta l = \frac{1}{DPI} = \frac{\omega_d \times r_d}{f_{SCAN}} \qquad \text{eq. 2}$$

As can be seen in equation 2, the scan line spacing is proportional to the drum angular velocity $\omega_d$. Thus, as revealed in equation 2, there is a strong correlation between drum velocity fluctuation and line spacing variation. Consistent line spacing can be achieved if the OPC drum velocity is maintained constant, assuming that the polygon mirror 22 does not wobble or have fluctuations in its velocity.

Conventional laser printers and other EP devices use a phase-lock loop (PLL) in the motor control circuit 66 to control the velocity of motor 64 shown in FIG. 3. Motor 64 may be a brushless DC motor that includes a rotor made of permanent magnets, a stator where the armature coils are attached and three Hall-effect sensors for detecting rotor position. The armature coils consist of concentrated windings, which are y-connected and fixed on a printed circuit board. Details of the operation of a BLDC motor are well known in the art.

FIG. 4 shows a typical PLL control circuit 80 used to control a motor 64 driving the OPC drum 24 via gear train 68. As is well known in the art, the PLL control circuit 80 is a feedback system that includes a phase comparator 82, a low-pass filter 84, an error amplifier 86 in the forward signal path that controls a pulse width modulation (PWM) generator 87. The PLL control circuit 80 includes a pulse generator 88 in the feedback path along with an oscillator 90 that generates a reference pulse to be compared to the signal produced by pulse generator 88. The desired angular velocity of motor 64 is proportional to the frequency of the reference pulses generated by the oscillator 90. The frequency of the signal generated by pulse generator 88, which may be, e.g., Hall-effect sensors in motor 64, is proportional to the angular velocity of motor 64. The phase comparator 82 compares the phase difference and produces an error signal that is proportional to the phase difference between the signals generated by oscillator 90 and pulse generator 88. The phase error produced by phase comparator 82 is passed through the low-pass filter 84 and the amplifier 86 to set a voltage level for the PWM generator 87, which is used to modulate the amount of current flowing through the motor 64 thereby adjusting the motor velocity.

As shown in FIG. 4, conventional PLL control circuit 80 regulates the velocity of the motor 64, not the velocity of the OPC drum 24. Because the motor shaft 65, gear train 68 and the OPC drum 24 are not rigidly connected, a constant motor velocity does not guarantee a constant OPC drum velocity. The pulse generator 88, which may be a Hall-effect sensor, will not be able to pick up disturbances introduced between the motor 64 and the OPC drum 24. Thus, disturbances in the velocity of the OPC drum 24 do not appear at all in the measurement of the motor velocity from pulse generator 88.

The effect of gear train noises, such as eccentricity and tooth-to-tooth error, are a non-negligible source of disturbance in the rotation of OPC drum 24. Because the formation of the image is directly related to the rotational motion of the OPC drum 24, the manufacturing and assembly tolerance of the OPC drum 24 assembly is a major contributor to drum velocity variation. The disturbance frequency caused by eccentricity and tooth-to-tooth error can be readily identified from the rotational speed. FIGS. 5A and 5B are graphs respectively showing the measured velocity of an OPC drum in a conventional EP device and the corresponding power spectrum. As can be seen from the power spectrum shown in FIG. 5B, disturbances in the conventional EP system manifest themselves as two types of velocity errors. The first type of disturbance is repetitive and has fundamental frequencies of 16, 24, and 48 Hz. The second type of disturbance is non-repetitive, where most of the non-repetitive disturbances have low frequencies lying below 16 Hz.

Figure 6:
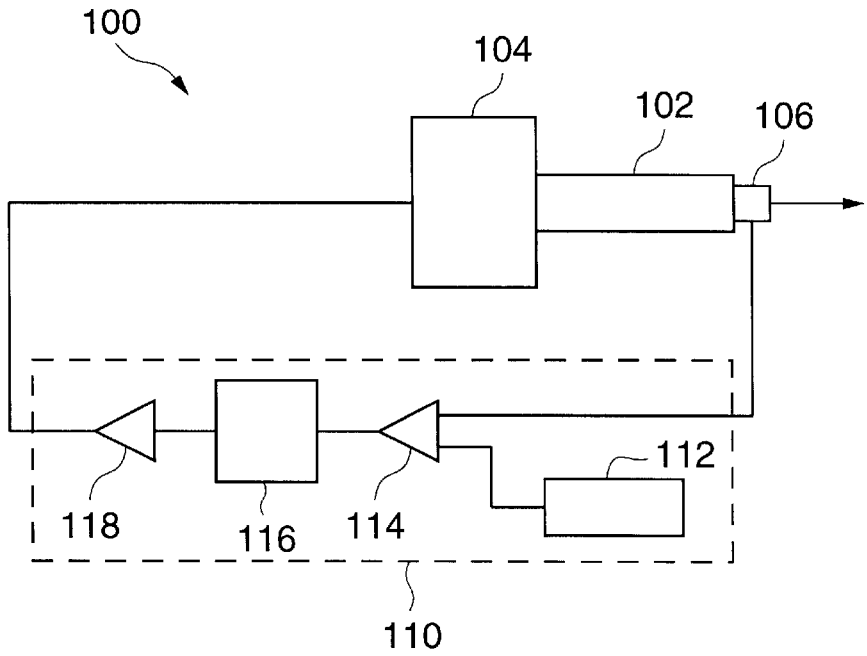
FIG. 6 shows a block diagram schematic view of a printer including an OPC drum driven by a motor, which is controlled by closed loop controller receiving a feedback signal from an encoder connected to the OPC drum.

In order to compensate for the disturbances that cause OPC drum velocity fluctuations, the present invention regulates the OPC drum velocity by directly measuring the drum velocity or position. FIG. 6 shows a schematic view of a printer 100 including an OPC drum 102 driven by a motor 104, which is controlled by controller 110. It should be understood that motor 104 drives OPC drum 102 either directly or indirectly through a drive train (not shown), which may be similar to drive train 68 shown in FIG. 4. A rotary encoder 106 is mounted on the OPC drum 102 and monitors the angular position of OPC drum 102. Encoder 106 provides a feedback signal to the controller 110. Thus, the angular position of the OPC drum 102 is used to control the drive signal from controller 110 to the motor 104, thereby stabilizing the velocity of the OPC drum 102, rather than stabilizing the velocity of the motor. In one embodiment, controller 110 is similar to PLL control circuit 80, shown in FIG. 4, and includes an oscillator 112, and comparator 114. Comparator 114 receives the reference pulse from oscillator 112 and the feedback signal from encoder 106. Comparator 114 produces an error signal, which is provided to amplifier 118 via low pass filter 116. Amplifier 118 accordingly drives motor 104, e.g., by way of a voltage controlled oscillator, such as a PWM circuit (not shown). Because the motor 104 rotates at a much higher velocity than the OPC drum 102, high resolution control of the velocity of OPC drum 102 is possible. A high resolution optical encoder 106 capable of 50,000 pulses per revolution may be used, however, lower resolution may also be used if desired. For example, an Agilent optical encoder module (QEDS-9854) with an Applied Imaging 200LPI codewheel may be used as encoder 106. Of course, if desired, the feedback signal to controller 110 may be the velocity of OPC drum 102 rather than the angular position.

Figure 7:
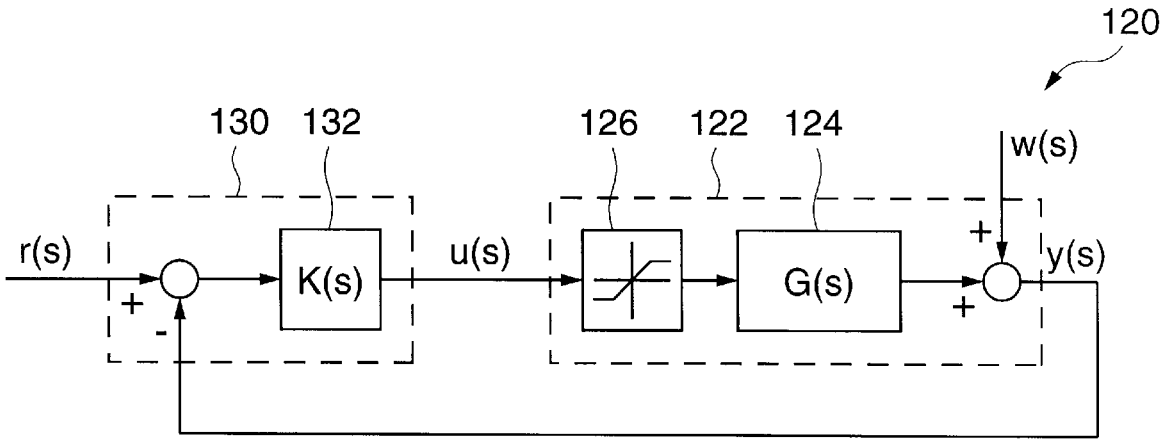
FIG. 7 is a block diagram of a closed loop system, in accordance with one embodiment of the present invention.

FIG. 7 is a block diagram of a closed loop system 120 that includes a controller 130, which may be used in place of controller 110 in FIG. 6. Controller 130 incorporates a human visual system model to reduce banding artifacts, i.e., controller 130 acounts for, in part, the effect of the human visual system in percieving banding, thereby reducing noticable banding artifacts, in accordance with another embodiment of the present invention.

As shown in FIG. 7, closed loop system 120 includes the plant 122, which includes the motor, the gear train, the OPC drum, and the encoder, all of which are represented by the transfer function G(s) 124. Also included in plant 122 is a saturation function 126 placed before the transfer function G(s) to model the allowable voltage range for driving the motor. The lower and upper limits of the saturation function 126 are due to the saturation of the energy flowing through the main motor windings. The saturation is a performance limiting element that limits the amount of available control effort. The signal w(s) represents the output disturbance, which takes a general definition that includes the periodic disturbances from the gear train and various rotational components, but also the non-periodic disturbances due to frictions and plant non-linearities. The plant 122 output y(s) is monitored in terms of the angular velocity or position of the OPC drum 24 by the encoder, e.g., encoder 106 shown in FIG. 6.

The controller 130 receives the signal r(s), which represents the reference or command signal, e.g., from oscillator 112 shown in FIG. 6, that is to be followed by the system output y(s). For example, command signal r(s) is the desired angular velocity of the OPC drum 102, e.g., 3.13576 rad/sec, and y(s) is the actual angular velocity of OPC drum 102. Of course, the command signal r(s) may be the desired angular position of the drum 102, while the output signal y(s) is the actual angular position of the drum 102. Converting the angular position to angular velocity of the drum 102 is well within the skill in the art. The controller 130 receives feedback in the form of the system output y(s) as monitored by encoder 106. The controller 130 includes a transfer function K(s) 132, which is to be specifically designed to reject the output disturbance w(s) in plant 122. Thus, controller 130 receives the command signal r(s) as well as the system output signal y(s) in a feedback loop, and transfer function K(s) produces a control signal u(s) to plant 122.

Figures 8, 8A:
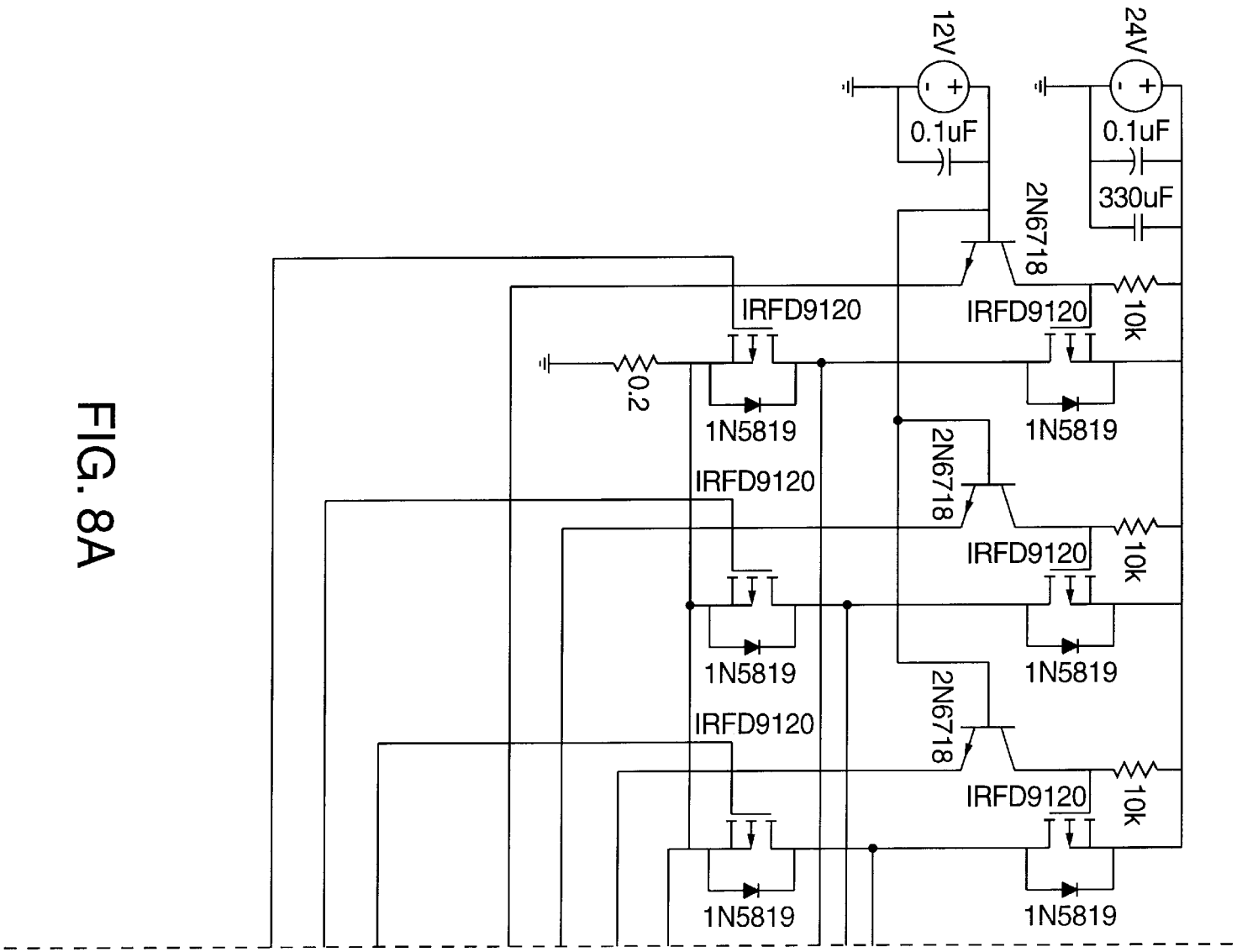
FIGS. 8A and 8B are schematic diagrams depicting a PWM driver circuit that may be used, in accordance with an embodiment of the present invention.
Figure 8B:
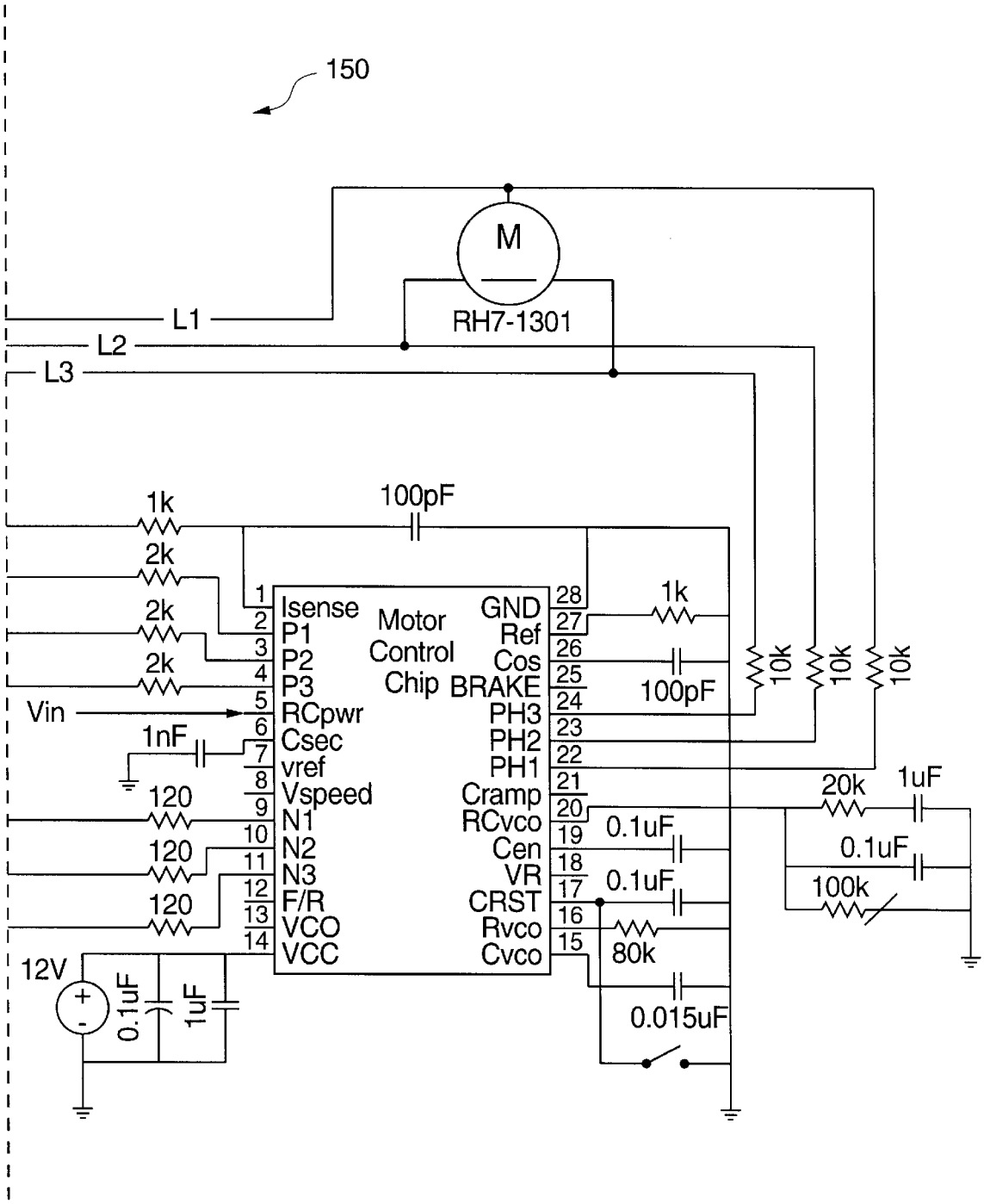

A PWM driver circuit 150, shown schematically in FIGS. 8A and 8B, is used, in accordance with an embodiment of the present invention, to provide direct control of the motor in plant 122, e.g., motor 104 shown in FIG. 6. The controller is implemented on a TI C60 DSP. The control signal u(s) is connected to the driver circuit 150 for setting the current level to the armature winding of the motor. The input to the controller is the angular position of the OPC drum 102 measured by an optical encoder. Shown in FIGS. 8A and 8B is an example of the motor driver circuit, not including controller 130. Vin FIGS. 8A and 8B is the control signal u(s) from the transfer function K(s) 132 in controller 130, which will adjust the voltage/current flowing through the motor thereby modulating the motor speed. The command signal r(s) and the transfer function K(s) 132 in controller 130 may be, e.g., implemented using hardware or software. For example, a microprocessor or a digital signal processor, such as Texas Instruments DSP TMS320C60, may be used. An example of suitable software that can be used to implement the command signal r(s) and transfer function K(s) is included in the compact disk attachment.

Figure 9A:
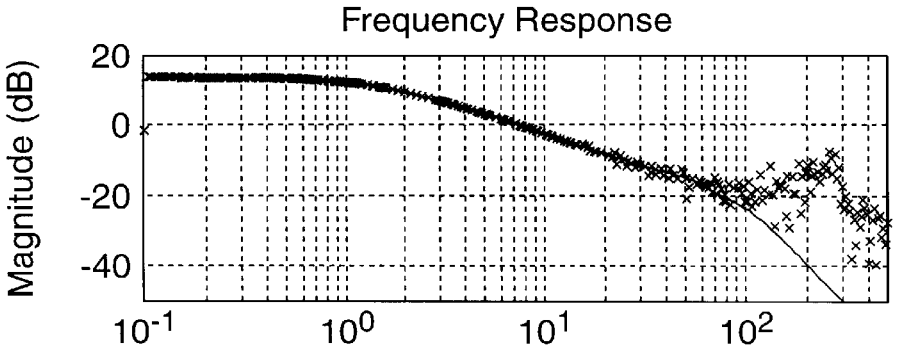
FIGS. 9A and 9B show the frequency response in magnitude and phase, respectively, of an open loop system.
Figure 9B:
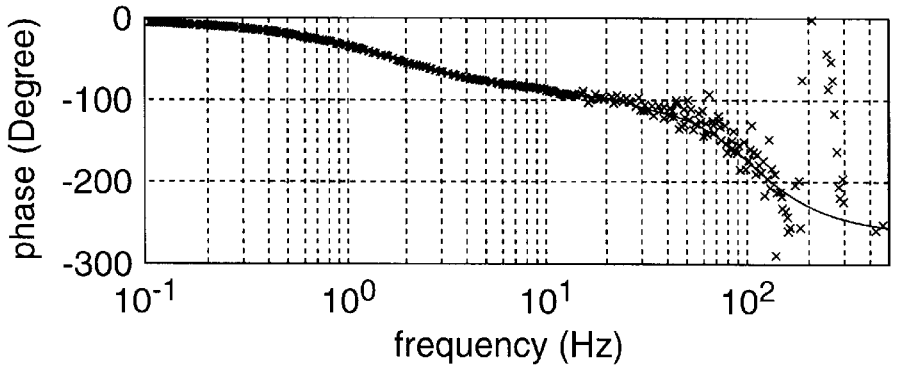

Before the controller 130 can be designed to reject the output disturbance w(s), the plant 122 must first be modeled, including finding a proper transfer function G(s) and saturation function 126. Open loop transfer function G(s) can be modeled by injecting a small amplitude sweep-sine signal into an open loop plant, i.e., into an actual printer without a feedback controller, and recording the resulting OPC drum velocity signal from an encoder mounted on the OPC drum. The frequency response is obtained, as shown in FIGS. 9A and 9B, which show the frequency response in magnitude and phase, respectively. A $3^{rd}$ order polynomial is fitted to the experimental frequency response, shown as the solid line in FIGS. 9A and 9B. The $3^{rd}$ order polynomial operates as the plant model, i.e., transfer function G(s). An acceptable transfer function, e.g., was found to be:

$$G(s) = \frac{2.046\times10^7}{s^3 + 801.3s^2 + 4.443\times10^5 s + 4.326\times10^6}. \quad \text{eq. 3}$$

Figure 10:
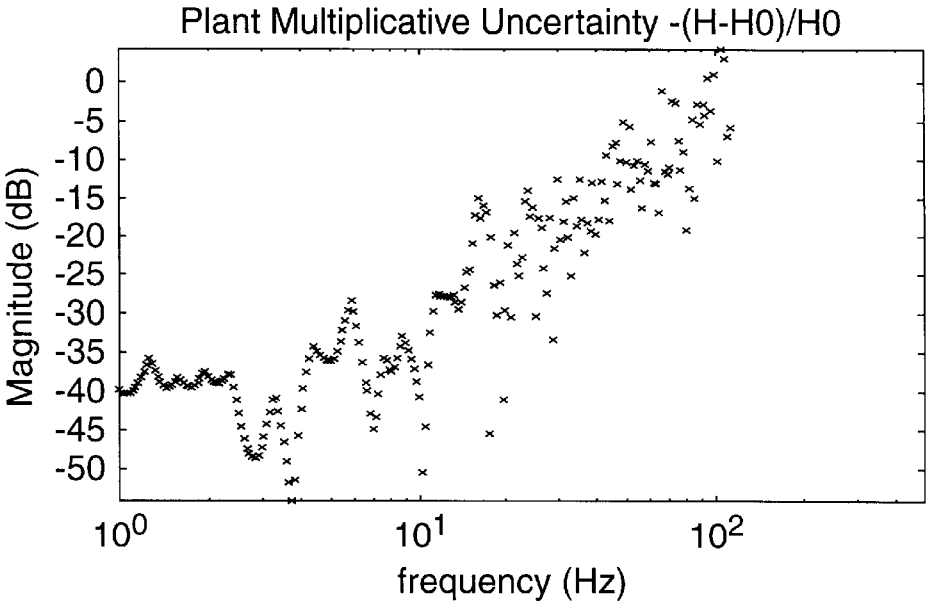
FIG. 10 shows the multiplicative model uncertainty for the $3^{rd}$ order plant model of equation 3 and FIGS. 9A and 9B.

It can be seen from FIGS. 9A and 9B, the transfer function G(s) fits the experimental frequency response for the plant until about 100 Hz. FIG. 10 shows the multiplicative model uncertainty for the $3^{rd}$ order plant model of equation 3 and FIGS. 9A and 9B, where the plant model uncertainty is (H-HO)/HO, and H represents the actual plant and HO represents the model of the plant used for designing the controller. The uncertainty for the plant model is attributed to the unmodeled structure dynamics, non-linearities, as well as the uncertainty and the limitations of the data acquisition equipment.

A step response of the experimental plant may be used to identify potential transportation lag (delay) in the system. The step response may be examined by introducing a step input to the motor and examining the response. The delay of the experimental open loop plant was found to be negligible.

The saturation function 126 is found by identifying the input range where the input and output relationship of the motor driver for the experimental plant is linear. For example, the BLDC motor driver was found to have a ±0.5 V linear operating range around a nominal operating voltage of 2.56V.

Once the plant 122 is modeled, i.e., a proper transfer function G(s) and saturation function 126 are found, the controller 130 can be designed so that transfer function K(s) rejects the disturbances w(s) using loop shaping. It is desirable to design controller 130 such that the open loop transfer function K(s)G(s) has high gain at the specific frequencies where disturbances are to be rejected. This guideline is complimented by actuator bandwidth and plant uncertainty constraints. The open-loop tranfer function K(s)G(s) gain needs to be reduced in the frequency range where large plant uncertainty and measurement noise are present. Ideally, the transfer function K(s) would eliminate all velocity variations of the OPC drum 102 to eliminate any velocity fluctuation induced banding. Unfortunately, there is uncertainty in the plant model transfer function G(s) as shown in FIG. 10, and the bandwidth and saturation limit of the motor driver, i.e., saturation function 126, will limit the achievable disturbance rejection performance.

Figure 11:
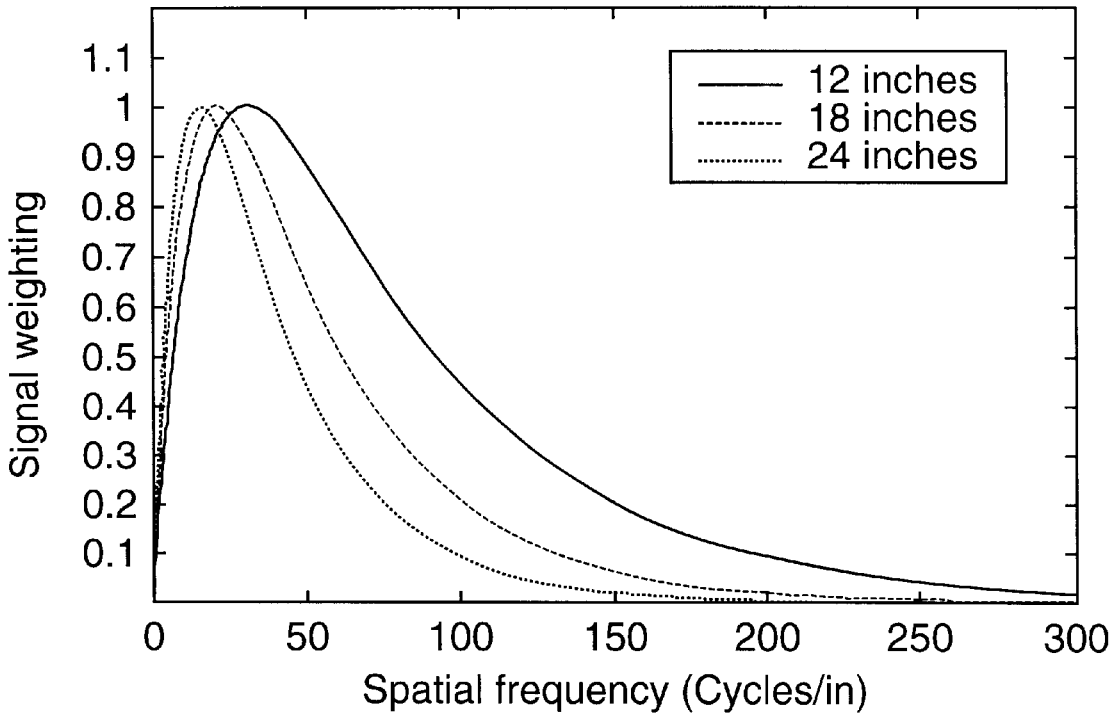
FIG. 11 is a graph of the contrast sensitivity function for different viewing distances, showing the decrease in sensitivity at high and very low frequencies.

A human visual system (HVS) model may be used advantageously in the design of the controller 130 to account for, in part, the effect of the human visual system in perceiving banding. Human eyes experience a decrease of contrast sensitivity both at high and very low spatial frequencies due to the cognitive interpretation of the brain. Thus, the human contrast sensitivity function (CSF) can be viewed as a bandpass filter. The CSF is a function of the average luminance of the image, the viewing distance and the printing resolution. FIG. 11 is a graph of the CSF for different viewing distances, showing the decrease in sensitivity at high and very low frequencies.

To reduce the effect of perceived banding, the human CSF may advantageously be used to shape the open-loop transfer function K(s)G(s) gain where high gain is required. For example, because the HVS has reduced sensitivity to contrast variation at higher spatial frequencies, as shown in FIG. 11, elimination of high spatial frequency banding by controller 130 is not necessary, i.e. the HVS filters out the "negative" impact of the high spatial frequency contrast variations.

The human CSF is used, in accordance with an embodiment of the present invention, for shaping the open loop transfer function K(s)G(s) gain where high gain is required to reduce the effect of banding. The human CSF provides guideline for reducing the open-loop transfer function gain to provide robustness for the actuator bandwidth limitation and model uncertainty.

As discussed above, the CSF is a function of viewing distance, spatial frequency, and luminance. The constrast sensitivity function can be approximated by a mathematical representation of the viewing distance, spatial frequency and average luminance. One example of the CSF that may be used in accordance with the present invention is:

$$CSF = S(L) \cdot e^{-\frac{\pi}{180}\alpha(L)v_d} f_{SPATIAL}, \quad \text{eq. 4}$$

where $$\alpha(L) = \frac{k}{c \ln(L) + d}, k = 1, c = 0.525, d = 3.91$$

However, other CSF functions, such as that described by J. L. Mannos and D. S. Sakrison, in "The Effects of a Visual Fidelity Criterion on the Encoding of Images", IEEE Transactions on Information Theory, Vol. IT-20, No. Jul. 4, 1974, which is incorporated herein by reference, may be used with the present invention if desired.

It is clear from equation 4 and FIG. 11 that the shape of the CSF is dependent on the viewing distance. As viewing distance decreases, higher spatial frequency banding becomes more noticable. Accordingly, a target viewing distance needs is determined before the CSF can be used to facilitate the design of the controller 130. By way of example, 24 inches may be used as the target viewing distance.

A couple of modifications of the CSF in equation 4 may be made, which will be useful in the design of controller 130. One useful modification is to translate the spatial frequency in the contrast sensitivity function into temporal frequency corresponding to the nominal rotational speed of the OPC drum 102. Translation into temporal frequency is achieved by assuming the OPC drum 102 rotates at a constant speed and using the following algebraic relationship between the spatial and temporal frequency:

$$f_{SPATIAL} = \frac{\omega_{TEMPORAL}}{2\Pi\omega_{DRUM}} \cdot r \quad \text{eq. 5}$$

where $f_{SPATIAL}$ denote the spatial frequency in cycles per inch, $\omega_{DRUM}$ is the rotating velocity of the drum in radians per second, r is the radius of the drum and $\omega_{TEMPORAL}$ denotes the temporal frequency in radians per second.

Another useful modification to the CSF is in the values at the low spatial frequency range. As discussed above, the CSF poses band-pass characteristics, where the value of the contrast sensitivity decreases significantly in the low as well as the high spatial frequency range. However, having some low frequency gain is useful to maintained an acceptable steady state regulation performance in feedback control design. Accordingly, the CSF for OPC drum velocity regulation may advantageously be modified to have a low-pass filter profile. Modifying the CSF to have a low-pass filter profile may be achieved by extending the maximum contrast sensitivity value to all lower spatial frequencies.

Figure 12:
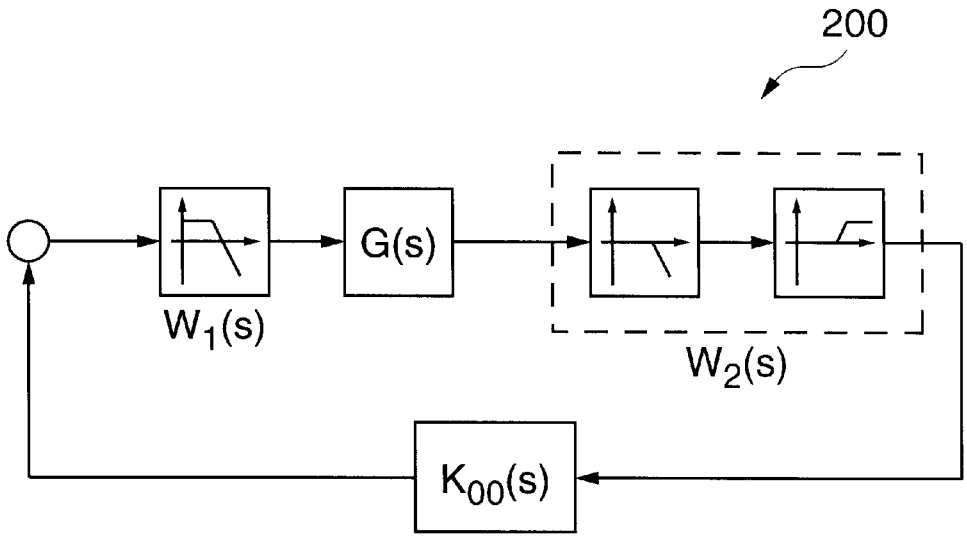
FIG. 12 shows an $H_\infty$ loop shaping controller synthesis approach that may be used to design a suitable controller, in accordance with an embodiment of the present invention.

FIG. 12 shows an $H_\infty$ loop shaping controller synthesis approach 200 that may be used to design a suitable controller 130, in accordance with an embodiment of the present invention. It should be understood, however, that because the magnitude profile of the modified CSF can be interpreted as the desired frequency dependent magnitude profile of the open-loop transfer function G(s) of the OPC drum velocity control system, any loop shaping controller synthesis approach can be employed to design a suitable controller.

As shown in FIG. 12, the $H_\infty$ loop shaping controller synthesis approach 200 includes a pre-compensator $W_1(s)$ and a post-compensator $W_2(s)$, both of which may be chosen to shape the loop transfer function of the augumented plant $W_2(s)$ G(s) $W_1(s)$ into the desired transfer function. The $K_\infty(s)$ is found by minimizing the infinity norm of the difference between K(s) $W_2(s)G(s)W_1(s)$ and $W_2(s)G(s)W_1(s)$. The transfer function K(s) for feedback controller 130 is then formed by combining $W_1(s)$, $W_2(s)$ and $K_\infty(s)$ by $$K(s)=W_1(s)K_\infty(s)W_2(s) \quad \text{eq. 6}$$

The pre-compensator $W_1(s)$ is chosen for the desired performance requirement, while the post-compensator $W_2(s)$ is chosen for stability and robustness considerations. For example, the pre-compensator $W_1(s)$ is chosen to be a stable and minimum phase filter that approximates the above-described modified CSF with a viewing distance of 24 inches, while the post-compensator $W_2(s)$ is chosen as a strictly proper filter that reduces gain at high frequencies to prevent the excitation of high frequency unmodeled dynamics of the plant to affect overall closed loop stability. In addition, the pre-compensator $W_1(s)$ and post-compensator $W_2(s)$ are chosen so that the orders are as low as possible to avoid producing a high order controller. By way of example, two acceptable filters are found as:

$$W_1(s) = \frac{s^2 + 1579s + 1.374 \times 10^6}{s^2 + 392.4s + 7.757 \times 10^4} \quad \text{eq. 7}$$

$$W_2(s) = \frac{1}{0.0008595s + 1} \quad \text{eq. 8}$$

Figure 13A:
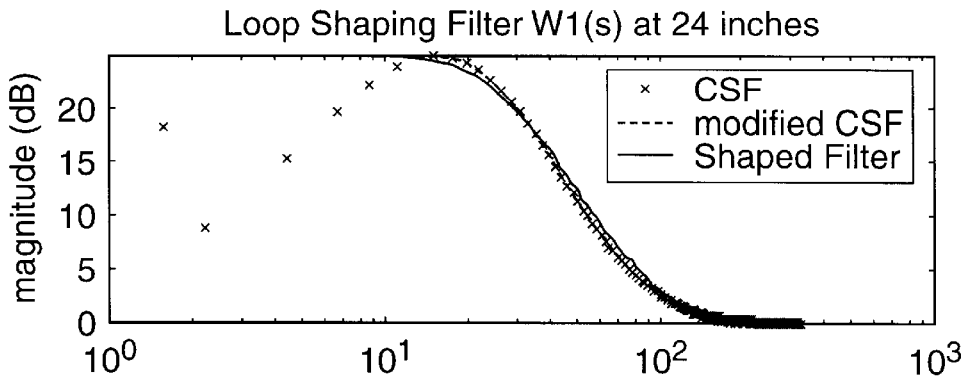
FIGS. 13A and 13B show the frequency responses of the pre-compensator $W_1(s)$ filter and the post-compensator $W_2(s)$ filter, respectively.
Figure 13B:
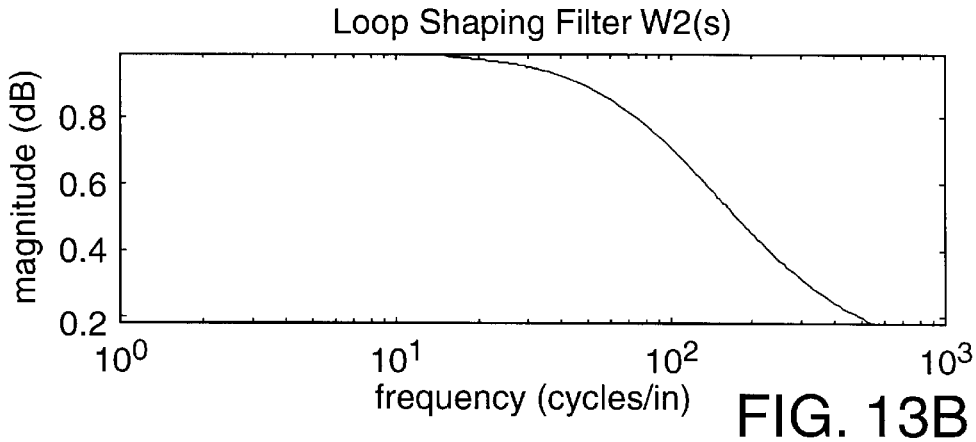

FIGS. 13A and 13B show the frequency responses of the pre-compensator $W_1(s)$ filter and the post-compensator $W_2(s)$ filter, respectively. FIG. 13A also shows the shape of the CSF and the modified CSF as described above. The pre-compensator $W_1(s)$ filter is selected to preserve the gain level up to around 100 cycles/in., because this is the region where the low frequency disturbances are most significant. The feedback controller 130 transfer function K(s) is obtained by minimizing the difference of the infinity norm of actual loop transfer function, $|K(s)W_2(s)G(s)W_1(s)|_\infty$, and the desired loop transfer function, $|W_2(s)G(s)W_1(s)|_\infty$. The result is an $8^{th}$ order compensator described by:

$$K(s) = \frac{M(s)}{N(s)}, \quad \text{eq. 9}$$

$$M(s)=3817s^7+1.35\times10^7s^6+2.28\times10^{10}s^5+2.25\times10^{13}s^4+1.38\times10^{16}s^3+5.94\times10^{18}s^2+1.42\times10^{21}s+1.70\times10^{23} \quad \text{eq. 9a}$$

$$N(s)=s^8+428s^7+8.07\times10^6s^6+9.26\times10^9s^5+7.34\times10^{12}s^4+4.06\times10^{15}s^3+1.49\times10^{18}s^2+3.11\times10^{20}s+3.28\times10^{22} \quad \text{eq. 9b}$$

Figure 14:
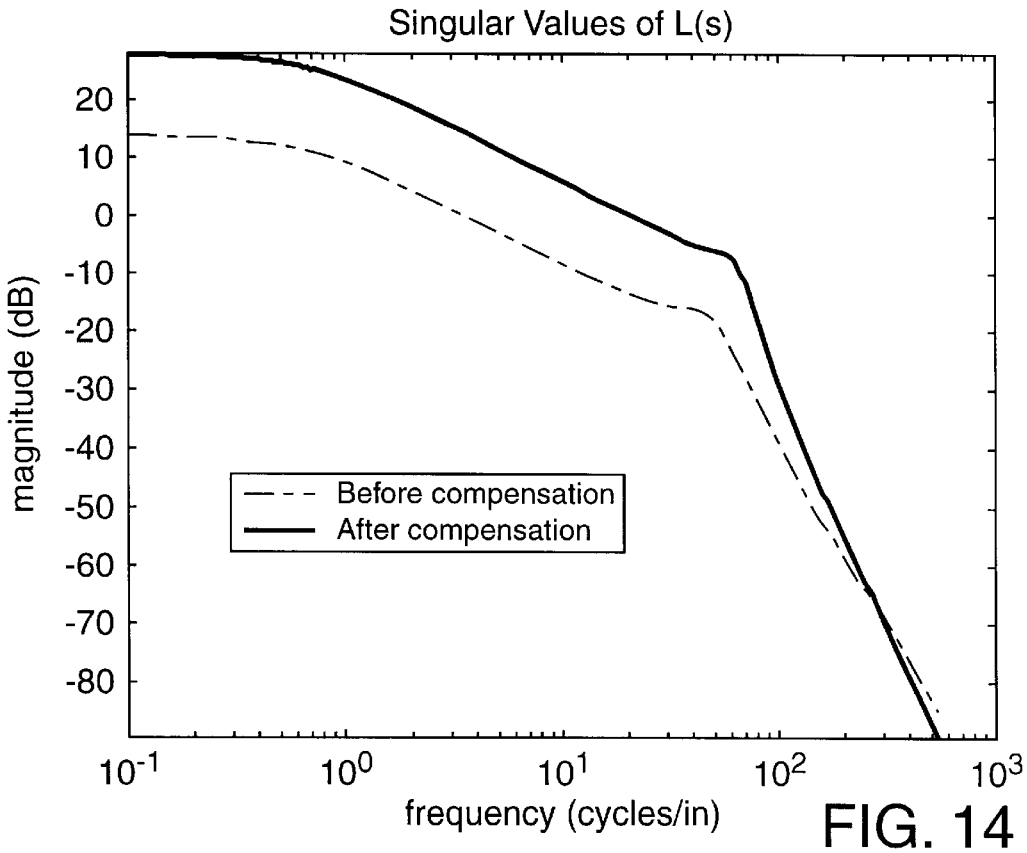
FIG. 14 is a graph comparing the singular values of the loop transfer function L(s)=K(s)G(s) of the uncompensated and compensated plant.

The minus sign in equation 9 means that positive feedback is needed for implementing the controller 130. FIG. 14 is a graph comparing the singular values of the loop transfer function L(s)=K(s)G(s) of the uncompensated and compensated plant 122. As can be seen in FIG. 14, the compensated plant 122 is gain-lifted up to 100 cycles/in by the loop shaping controller 130.

Thus, the controller 130 is a HVS based loop shaping controller that is designed to incorporate the human CSF into the primary loop design to account for the effect of the human visual system in interpreting non-periodic and low spatial frequency artifacts. Advantageously, the HVS based controller also helps to eliminate DC drifts as well as provide robustness to the OPC drum velocity control loop. The controller 130 may be a digital signal processor or microprocessor operating upon suitable software, such as that included in the compact disk attachment, to implement the desired transfer function. Alternatively, controller 130 may be implemented in hardware, for example, using a series of op-amps, which is well within the abilities of those skilled in the art.

In accordance with another embodiment of the present invention, controller 130 includes a secondary control loop that is a repetitive controller designed to compensate for the periodic disturbances that are the major contributors to banding artifacts. With the removal of the DC components of the disturbances by the HVS based controller 130, discussed above, the nominal (mean) value of the angular velocity of the OPC drum 102 is constant. Thus, the fundamental and harmonic frequencies of the periodic disturbances will be stationary and the repetitive controller can be applied directly without modification.

Figure 15:
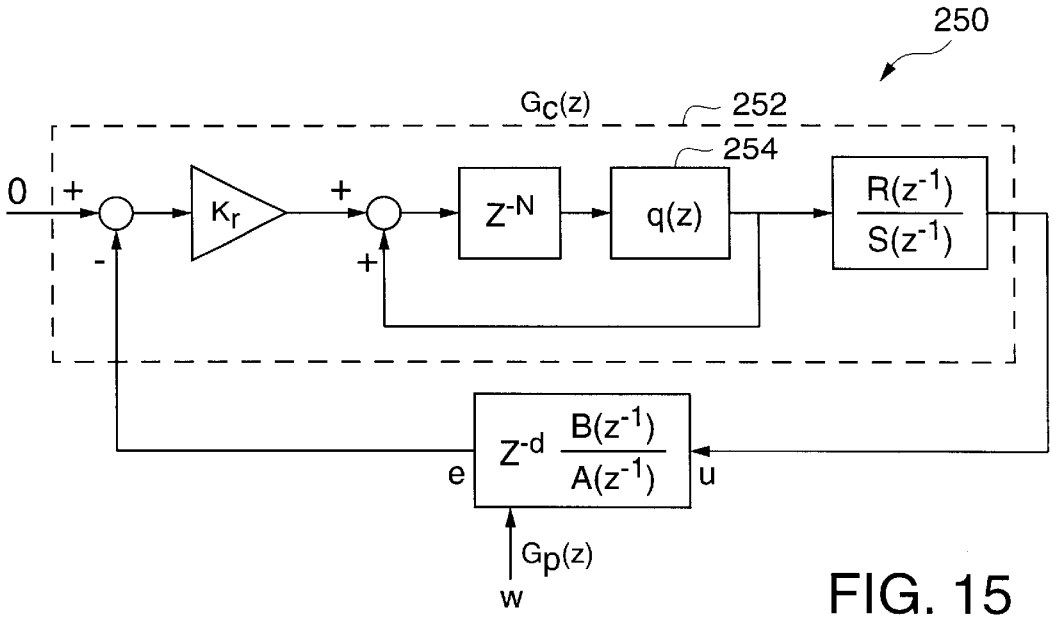
FIG. 15 shows a closed loop system, that includes a discrete time version of the closed loop system $G_p(z)$, which is, e.g., the closed loop system shown in FIG. 7, with a repetitive controller $G_c(z)$ 252 that provides a control input signal u to closed loop system $G_p(z)$ and receives a feedback signal e, in accordance with an embodiment of the present invention.

In discrete-time domain, any periodic signal with fundamental period of N can be generated by a series of delay taps with unity positive feedback and a set of non-zero initial conditions. A repetitive controller is capable of rejecting disturbances that are harmonics of a certain fundamental frequency. FIG. 15 shows a closed loop system 250, that includes a discrete time version of the closed loop system $G_p(z)$, which is, e.g., the closed loop system 120 shown in FIG. 7, with a repetitive controller $G_c(z)$ 252 that provides a control input signal u to closed loop system Gp(z) and receives a feedback signal e, in accordance with an embodiment of the present invention. It should be understood that repetitive controller 252 may be used advantageously to reject periodic disturbances without the use of a modified CSF controller 130. For example, repetitive controller 252 may be used with any closed loop system, such as a proportional integral derivative controller, a phase locked loop controller, a lead lag compensation controller or any other appropriate controller.

Figure 16:
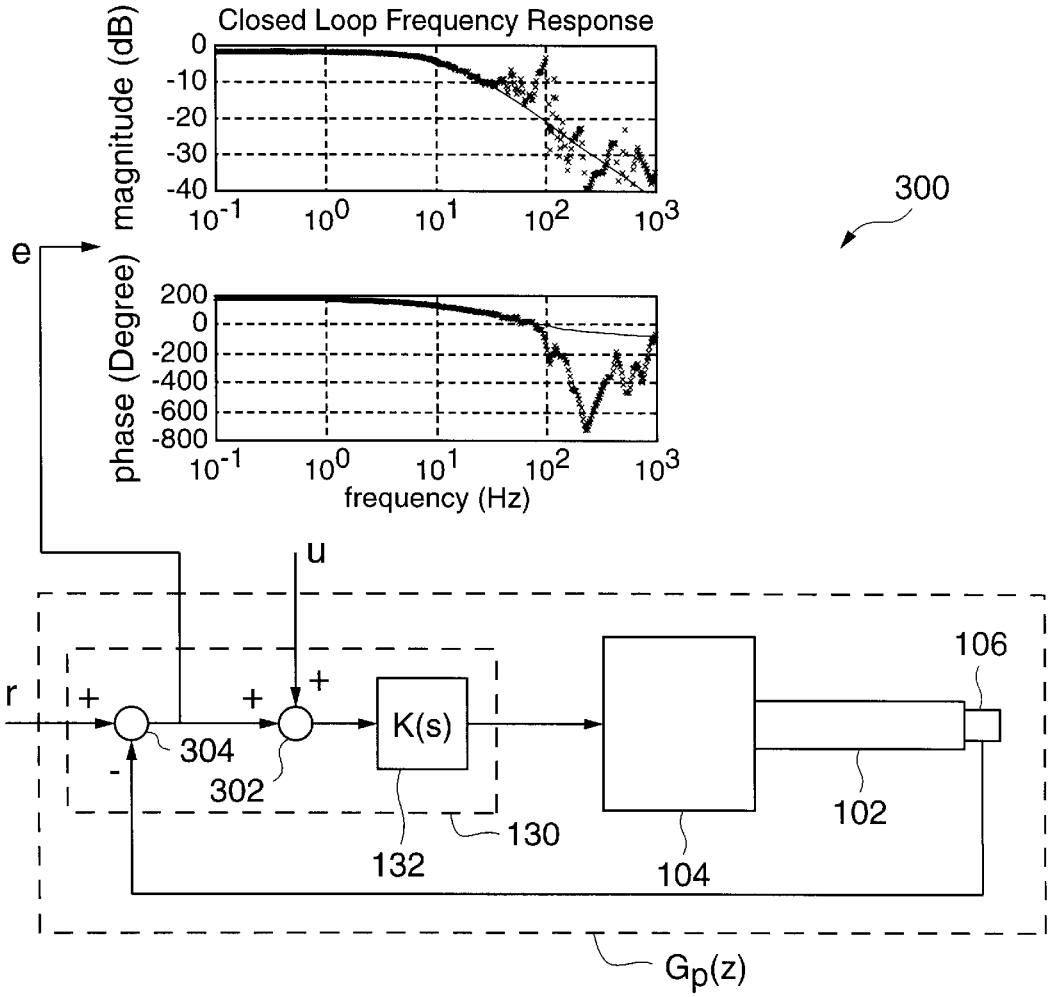
FIG. 16 shows a repetitive controller synthesis approach that may be used to design repetitive controller.

FIG. 16 shows a repetitive controller synthesis approach 300 that may be used design repetitive controller 252. FIG. 16 shows a discrete-time version of the closed loop system $G_p(z)$, which includes the plant, i.e., motor 104 (including the drive train), OPC drum 102, and encoder 106, and also includes, in one embodiment, the modified CSF loop shaped controller 130. Thus, closed-loop system $G_p(z)$ represents the transfer function from the controller input r to the velocity error from encoder 106. A periodic control input signal u is provided to the closed loop system Gp(z) prior to transfer function K(s) at node 302, and the system response e is received after the feedback node 304. The frequency response is obtained from e in magnitude and phase, as shown in FIG. 16. Using the frequency response the closed loop system $G_p(z)$ can be modeled, e.g., using a $3^{rd}$ order polynomial fit. Let the identified closed-loop system $G_p(z)$ take the form as:

$$G_p(z) = z^{-d}\frac{B(z^{-1})}{A(z^{-1})} = z^{-d}\frac{B^+(z^{-1})B^{-1}(z^{-1})}{A(z^{-1})} \qquad \text{eq. 10}$$

where d is the number of delay steps in the system. $A(z^{-1})$ and $B(z^{-1})$ are denominator and numerator polynomials in $z^{-1}$, respectively. $B+(z^{-1})$ and $B^-(z^{-1})$ are parts of $B(z^{-1})$ with the cancelable and uncancelable zeros, respectively. That is, $B+(z^{-1})$ has zeros of $B(z^{-1})$ lying inside the unit circle on the z plane, while $B^-(z^{-1})$ has zeros of $B(z^{-1})$ lying on or outside the unit circle. When the value of the filter 254 is q (z)=1, the prototype repetitive controller $G_c(z)$ can be synthesized as:

$$G_c(z) = k_r\frac{R(z^{-1})z^{-N}}{S(z^{-1})1 - z^{-N}} \qquad \text{eq. 11}$$

where $$0<k_r<2$$

$$R(z^{-1})=k_r z^d A(z^{-1})B^-(z)$$

$$B^-(z)=\text{Replace } z^{-1} \text{ in } B^-(z^{-1}) \text{ with z}$$

$$S(z^{-1})=B^+(z^{-1})b$$

$$b\leq\max B^-(e^{-jw})|^2,\ w\epsilon[0,\pi]$$

and $N=f_s=f_w$, where $f_s$ is the sampling frequency of the discrete-time system and $f_w$ is the fundamental frequency of disturbances to be rejected. Basically, the repetitive controller cancels the poles and cancelable zeros of the closed loop system and uses $B^-(z)$ to compensate the phase shift due to the uncancelable zeros. The bounds imposed on $k_r$ and b are to ensure stability of the closed-loop system. The value for b may be chosen by:

$$b=(|_0|+|b_1|+\ldots+|b_m|)^2 \qquad \text{eq. 12}$$

or $$b=[B^-(1)]^2 \text{ if all the zeros of } B^-(z^{-1}) \text{ are in the closed left half plane} \qquad \text{eq. 13}$$

or $$b=[B^-(-1)]^2 \text{ if all the zeros of } B^-(z^{-1}) \text{ are in the closed right half plane. eq. 14}$$

The repetitive controller 252 can thus be synthesized using equations 10–14 and the closed loop frequency response obtained from FIG. 16. The repetitive controller 252 may be a digital signal processor or microprocessor operating upon suitable software, such as that included in the compact disk attachment, to implement the desired transfer function. Alternatively, repetitive controller may be implemented in hardware, for example, using a series of op-amps, which is well within the abilities of those skilled in the art.

The use and synthesis of reptitive controllers is well known in the art. For more information regarding repetitive controllers, see M. Tomizuka, T. C. Tsao and K. K. Chew, "Analysis and synthesis of discrete-time repetitive controllers," *ASME J. Dynamic Systems, Measurements and Control*, vol. 111, no. 3, pp. 353–358, September 1989, which is incorporated herein by reference.

To achieve robust stability, a low pass Q-filter q(z) 254 is introduced as shown in FIG. 15. The general expression of a Q-filter is $$q(z) = \frac{c_p(z^{-p}+z^p)+c_{p-1}(z^{-(p-1)}+z^{p-1})+\ldots+c_0}{2c_p+2c_{p-1}+\ldots+c_0} \qquad \text{eq. 15}$$

where $$c_0>c_1>\ldots>c_p. \qquad \text{eq. 16}$$

While the addition of the Q-filter 254 sacrifices the ability of the repetitive controller 252 to attenuate high frequency disturbances, the filter 254 improves the robust stability of the closed-loop system 250 under high frequency plant uncertainties.

Figure 17A:
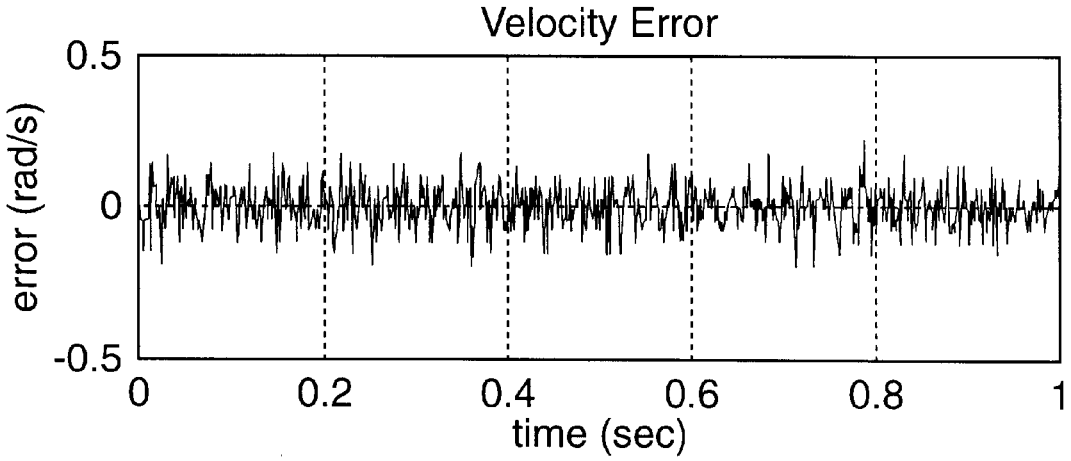
FIGS. 17A and 17B show the respective velocity error and the disturbance spectrum of the OPC drum using the HVS based loop-shaping controller.
Figure 17B:
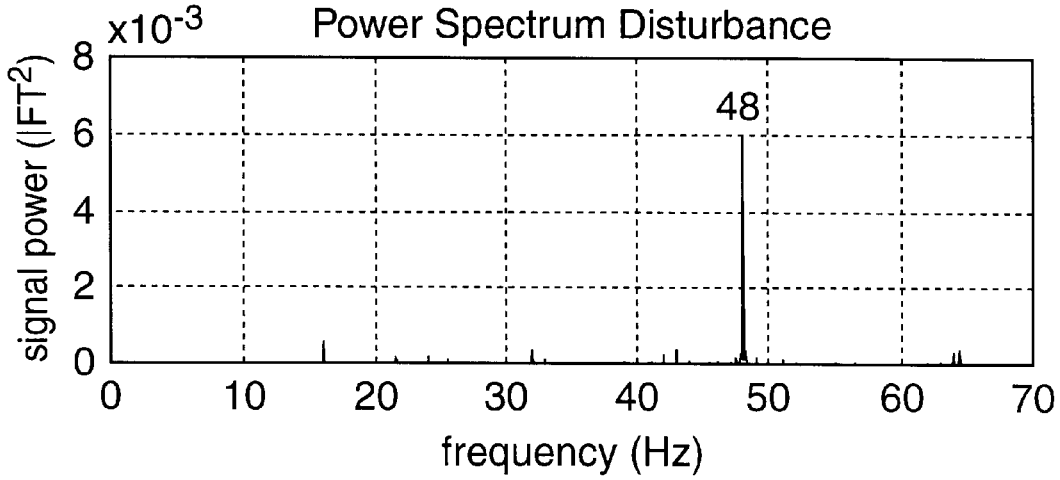

Thus, by way of example, the repetitive control scheme is applied to a 600 DPI electrophotographic printer, which has a scanning frequency $f_{SCAN}$ of 1111 Hz. The encoder 106 resolution is set to 50,000 pulses/rev with 2-bit interpolation. The sampling frequency of the experimental system is set to 1200 Hz. FIGS. 17A and 17B show the respective velocity error and the disturbance spectrum of the OPC drum 102 using the HVS based loop-shaping controller 130. Compared to FIGS. 5A and 5B, it can be seen that all the low frequency disturbances up to 40 Hz were significantly attenuated by controller 130. The remaining disturbance is at 48 Hz. The amplification of the disturbance at 48 Hz can be explained by the Cauchy sensitivity integral theorem.

Figure 18A:
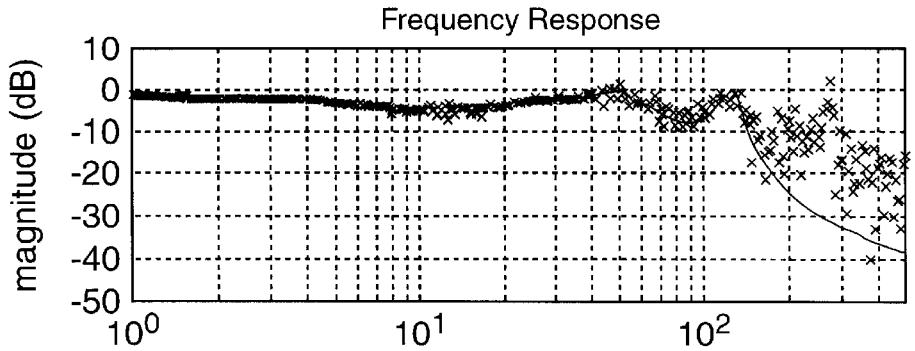
FIGS. 18A and 18B show the frequency response in magnitude and phase, respectively, of a closed loop system.
Figure 18B:
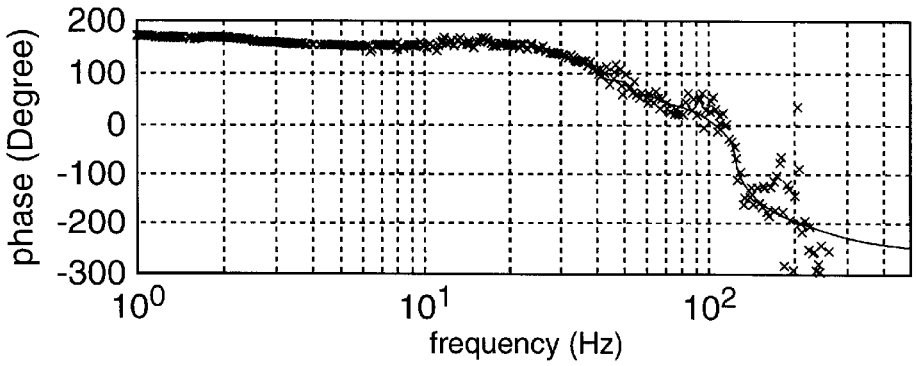

To implement the second level repetitive controller 252, the closed-loop system, $G_p(z)$, needs to be identified. The closed-loop system $G_p(z)$ is identified based on the frequency response of the system, as discussed in reference to FIG. 16. The frequency response is obtained, as shown in FIGS. 18A and 18B, which show the frequency response in magnitude and phase, respectively. A $3^{rd}$ order polynomial is fitted to the experimental frequency response, shown as the solid line in FIGS. 18A and 18B. The $3^{rd}$ order polynomial operates as the closed-loop system $G_p(z)$ model, which was found to be:

$$G_p(z^{-1}) = \frac{z^{-1}(-0.01957 + 0.07826z^{-1} - 0.1437z^{-2} + 0.1197z^{-3} - 0.03519z^{-4})}{1 - 4.2971z^{-1} + 7.7448z^{-2} - 7.3329z^{-3} + 3.6426z^{-4} - 0.7569z^{-5}}. \quad \text{eq. 17}$$

The one step delay $z^{-1}$ comes from discretizing the identified continuous-time system into its zero-order-hold (ZOH) equivalence. Following the above-mentioned synthesis procedure, the repetitive controller can be expressed as $$G_c(z^{-1}) = k_r \cdot \frac{z^{-N+d+1}}{1 - z^{-N}} \cdot \frac{R(z^{-1})}{S(z^{-1})} \quad \text{eq. 18}$$

where $$k_r = 0.12,\ d = 2$$

$$R(z^{-1}) = (1 - 4.2971z^{-1} + 7.7448z^{-2} - 7.3329z^{-3} + 3.6426z^{-4-0.75688}z^{-5}) \times (2.86761 - 2.3873z^{-1} + z^{-2})$$

$$S(z^{-1}) = -0.01957 + 0.03154z^{-1} - 0.01227z^{-2}$$

Because the frequency of the repetitive disturbance after closing the loop using the HVS based controller 130 is 48 Hz, the period N of the repetitive controller 252 is set to be N=1200/48 25. To improve the overall system robustness, a low order moving average q-filter 254 is selected:

$$q(z) = \frac{z^{-1} + 2 + z}{4}. \quad \text{eq. 19}$$

Figure 19A:
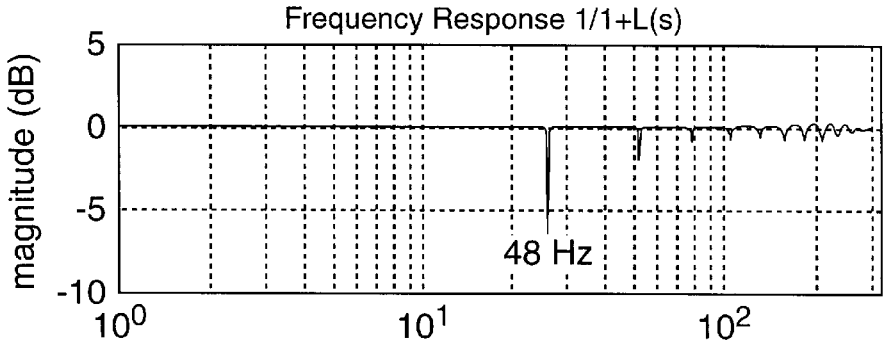
FIGS. 19A and 19B show the frequency response in magnitude and phase, respectively, of the repetitively controlled system from disturbance to velocity after incorporating a second order Q-filter.
Figure 19B:
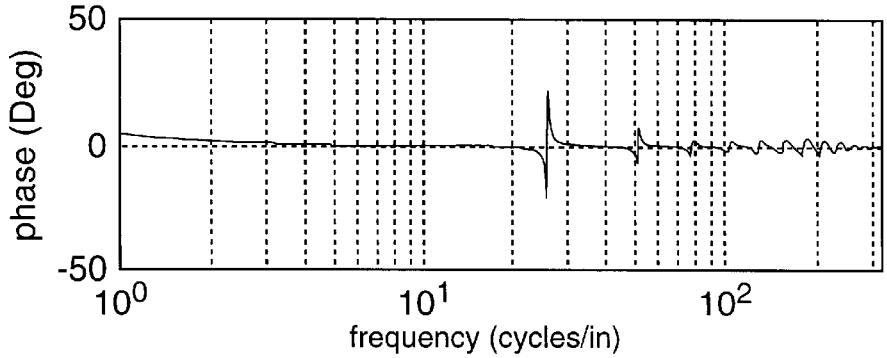

The frequency response of the repetitively controlled system 250 from disturbance to velocity after incorporating the second order Q-filter 254 is shown in FIGS. 19A and 19B in magnitude and phase, respectively, where the repetitive controller 252 is turned on after the loop-shaping controller 130 is activated.

Figure 20A:
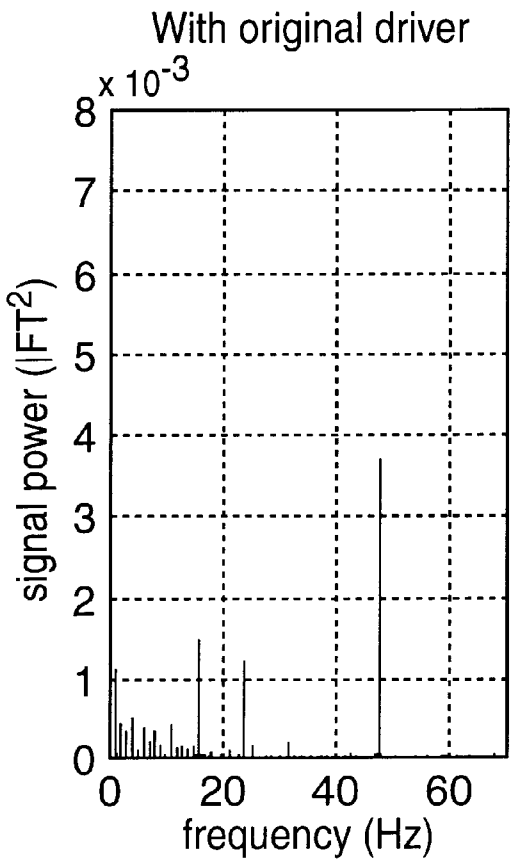
FIGS. 20A, 20B, and 20C show the comparison of the disturbance spectrum in an EP device before compensation, with the loop-shaping controller, and with the loop shaping controller plus the repetitive controller, respectively.
Figure 20B:
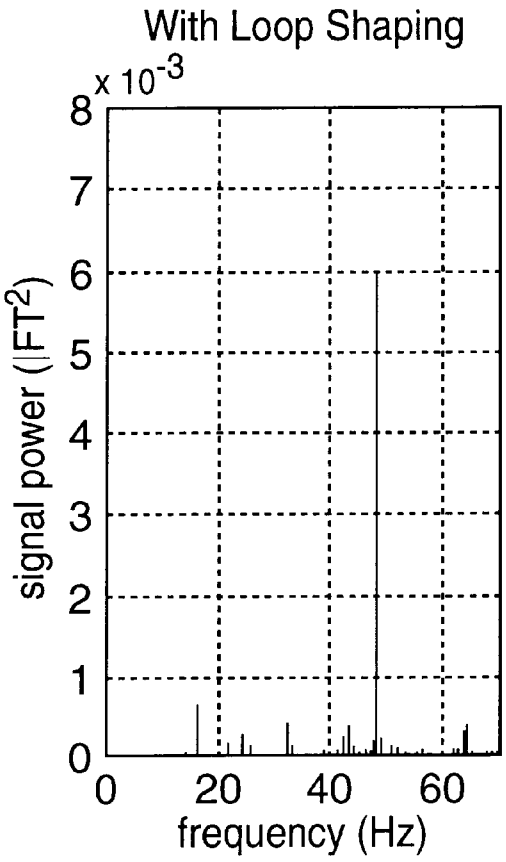
Figure 20C:
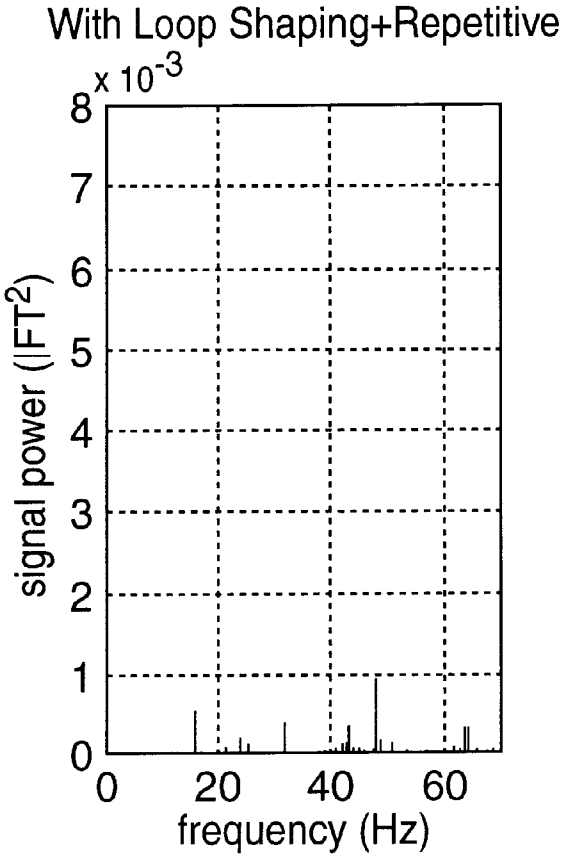

FIGS. 20A, 20B, and 20C show the comparison of the disturbance spectrum in a printer before compensation, with the loop-shaping controller 130, and with the loop shaping controller 130 plus the repetitive controller 252, respectively. It can be seen that the repetitive controller has significantly rejected the disturbance at 48 Hz.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. An electrophotographic device comprising:

a rotatable drum;

a motor coupled to said drum, said motor being operative to drive said drum;

an encoder coupled to said drum, said encoder being operative to monitor at least one of position and angular velocity of said drum;

a controller coupled to said motor and said encoder, wherein said controller comprises:

an oscillator operative to provide a reference signal;

a comparator coupled to said oscillator and operative to receive said reference signal from said oscillator, said comparator coupled to said encoder and operative to receive said at least one of the position and angular velocity of said drum from said encoder, said comparator having an output terminal and being operative to provide an error signal at said output terminal; and a filter coupled to the output terminal of said comparator, said filter being operative to receive said error signal, said filter having an output terminal, said controller controlling rotation of said drum based on at least one of the position and angular velocity of said drum.

2. The electrophotographic device of claim 1, further comprising:

a drive train disposed between said motor and said drum.

3. The electrophotographic device of claim 1, further comprising:

an amplifier coupled to said filter, said amplifier having an output terminal coupled to said motor.

4. The electrophotographic device of claim 1, wherein said controller approximates a human visual system model.

5. The electrophotographic device of claim 4, wherein said human visual system model is a human contrast sensitivity function.

6. The electrophotographic device of claim 5, wherein said human contrast sensitivity function is modified to have a low-pass filter profile.

7. The electrophotographic device of claim 5, wherein said human contrast sensitivity function is modified to be in temporal frequency corresponding to the nominal rotational speed of said drum.

8. The electrophotographic device of claim 1, further comprising:

a repetitive controller coupled to said controller in a secondary control loop, said repetitive controller being operative to compensate for periodic disturbances in rotation of said drum.

9. The electrophotographic device of claim 1, further comprising:

means for compensating for periodic disturbances in rotation of said drum.

10. An electrophotographic device, comprising:

a rotating drum;

a motor coupled to said drum, said motor drives the rotation of said rotating drum; and a closed-loop controller coupled to said motor, said closed-loop controller controls the angular velocity of said motor that drives said rotating drum, said closed-loop controller approximating a human visual system model.

11. The electrophotographic device of claim 10, wherein said human visual system model is a human contrast sensitivity function.

12. The electrophotographic device of claim 11, wherein said human contrast sensitivity function is described by:

$$CSF = S(L) \cdot e^{-\frac{\pi}{180}\alpha(L)v_d} f_{SPATIAL},$$

where $v_d$ is viewing distance, $f_{spatial}$ is spatial frequency, L is luminance, $S(L)=aL^b$, and $a(L)=k/(cln(L)+d)$, where a, b, c, d, and k are constants.

13. The electrophotographic device of claim 11, wherein said human contrast sensitivity function is modified to have a low-pass filter profile.

14. The electrophotographic device of claim 11, wherein said human contrast sensitivity function is modified to be in temperal frequency corresponding to the nominal rotational speed of said dram.

15. The electrophotographic device of claim 11, further comprising:

an encoder coupled to said rotating drum and said closed-loop controller, said encoder monitoring at least one of the position and angular velocity of said rotating drum, and providing a feedback signal to said closed-loop controller.

16. The electrophotographic device of claim 10, further comprising:

a drive train disposed between said motor and said rotating drum.

17. The electrophotographic device of claim 10, further comprising:

a repetitive controller coupled to said closed-loop controller in a secondary control loop, said repetitive controller designed to compensate for the periodic disturbances in the rotation of said rotating drum.

18. An electrophotographic device, comprising:

a rotating drum;

a motor coupled to said drum, said motor drives the rotation of said rotating drum;

an encoder coupled to said rotating drum, said encoder monitoring at least one of the position and angular velocity of said rotating drum;

a closed-loop controller coupled to said motor and said encoder that provides a feedback signal to said closed-loop controller, said closed-loop controller controls the angular velocity that said motor drives said rotating drum, said closed-loop controller approximates the human visual system; and a repetitive controller coupled to said closed-loop controller in a secondary control loop, said repetitive controller designed to compensate for the periodic disturbances in the rotation of said rotating drum.

19. An electrophotographic device, comprising:

a rotating drum;

a motor coupled to said drum, said motor drive the rotation of said rotating drum;

an encoder coupled to said rotating drum; said encoder monitoring at least one of the position and angular velocity of said rotating drum;

a closed-loop controller coupled to said motor and said encoder that provides a feedback signal to said closed-loop controller, said closed-loop controller controls the angular velocity that said motor drives said rotating drum; and a repetitive controller coupled to said closed-loop controller in a secondary control loop, said repetitive controller designed to compensate for the periodic disturbances in the rotation of said rotating drum.

20. The electrophotographic device of claim 19, wherein said closed loop controller incorporates the human contrast sensitivity function modified to have a low-pass filter profile and to be in temperal frequency.

21. A method of controlling the velocity of a rotating drum in an electrophotographic device to reduce banding artifacts, said method comprising:

providing a control signal to a motor that drives said rotating drum;

monitoring at least one of the position and angular velocity of said rotating drum;

providing a reference signal;

comparing said reference signal to said at least one of the position and angular velocity of said rotating drum to produce an error signal;

filtering said error signal; and varying said control signal to said motor based on said at least one of the position and angular velocity of said rotating drum by amplifying the filtered error signal to produce said control signal.

22. The method of claim 21, further comprising:

driving said rotating drum with a drive train.

23. A method of controlling the velocity of a rotating drum in an electrophotographic device to reduce banding artifacts, said method comprising:

providing a command signal;

receiving a feedback signal of at least one of the position and angular velocity of said rotating drum; and using said command signal and said feedback signal in a primary control loop incorporating the human visual system to produce a control signal by:

producing an error signal based on said command signal and said feedback signal;

filtering said error signal, wherein said filtering at least partially filters out low frequency and non-periodic drum rotational velocity fluctuations to approximate the human visual system; and providing said control signal based on the filtered error signal.

24. The method of claim 23, further comprising:

adding a repetitive control signal to said error signal prior to said filtering said error signal;

receiving said error signal as a second feedback signal in a secondary control loop prior to adding said repetitive control signal to said error signal; and producing said repetitive control signal based on said error signal to reduce the effect of periodic drum rotational velocity fluctuations.

25. A method of controlling the velocity of a rotating drum in an electrophotographic device to reduce banding artifacts, said method comprising:

providing a command signal;

receiving a feedback signal of at least one of the position and angular velocity of said rotating drum; and using said command signal and said feedback signal in a primary control loop incorporating the human visual system to produce a control signal, wherein said primary control loop incorporates the human contrast sensitivity function modified to have a low-pass filter profile and to be in temporal frequency.

26. A method of controlling the velocity of a rotating drum in an electrophotographic device to reduce banding artifacts, said method comprising:

providing a command signal;

receiving a feedback signal of at least one of the position and angular velocity of said rotating drum;

using said command signal and said feedback signal in a primary control loop incorporating the human visual system to produce a control signal; and providing a repetitive controller in a secondary control loop to reduce the effect of periodic drum rotational velocity fluctuations.

27. A method of controlling the velocity of a rotating drum in an electrophotographic device to reduce banding artifacts, said method comprising:

providing a command signal;

receiving a feedback signal of at least one of the position and angular velocity of said rotating drum;

producing an error signal based on said command signal and said feedback signal;

using said error signal in a primary control loop incorporating the human visual system to produce a control signal to a motor that drives said rotating drum; and using said error signal in a secondary control loop incorporating a repetitive controller to produce a repetitive command signal that is added to said error signal, wherein said produced control signal to said motor incorporates said repetitive command signal.

28. The method of claim 27, wherein producing said control signal to a motor comprises:

adding said repetitive command signal and said error signal;

filtering said repetitive command signal and said error signal, wherein said filtering at least partially filters out low frequency and non-periodic drum rotational velocity fluctuations to approximate the human visual system; and providing said control signal to said motor based on the filtered repetitive command signal and said error signal;

receiving said error signal prior to adding said repetitive command signal in said secondary control loop; and using said error signal to produce said repetitive control signal to reduce the effect of periodic drum rotational velocity fluctuations.

29. The method of claim 27, wherein said primary control loop incorporates the human contrast sensitivity function modified to have a low-pass filter profile and to be in temperal frequency.

30. A method of designing a closed loop controller for an electrophotographic device to reduce banding artifacts, said method comprising:

modeling an open loop transfer function for an electrophotographic device; and using loop shaping to design said closed loop controller with respect to said open loop transfer function to incorporate the human visual system model, wherein modeling said open loop transfer function for said electrophotographic device comprises:

producing the frequency response of said electrophotographic device; and mathematically describing said frequency response.

31. A method of designing a closed loop controller for an electrophotographic device to reduce banding artifacts, said method comprising:

modeling an open loop transfer function for an electrophotographic device; and using loop shaping to design said closed loop controller with respect to said open loop transfer function to incorporate the human visual system model, wherein using loop shaping comprises:

augmenting said open loop transfer function with a pre-compensator and a post-compensator;

minimizing the infinity of norm of the open loop transfer function augmented with said pre-compensator and said post-compensator;

forming the transfer function for said closed loop controller using the minimized infinity norm and pre-compensator and said post-compensator; and using said transfer function for said closed loop controller to design said closed loop controller.

32. The method of claim 31, wherein:

said pre-compensator approximates the human contrast sensitivity function modified to have a low-pass filter profile and to be in temperal frequency; and said post-compensator is chosen to reduce gain at high frequencies.

33. A method of controlling the velocity of a rotating drum in an electrophotographic device to reduce banding artifacts, said method comprising:

using a primary controller in a primary control loop to control the rotational velocity of a rotating drum in said electrophotographic device; and using a repetitive controller in a secondary control loop to control said primary controller to reduce the effect of periodic drum rotational velocity fluctuations in producing banding artifacts.

34. The method of claim 33, wherein using a primary controller in a primary control loop comprises:

providing a command signal;

receiving a feedback signal of at least one of the position and angular velocity of said rotating drum;

producing an error signal based on said command signal and said feedback signal; and using said error signal in a primary control loop to produce a control signal to a motor that drives said rotating drum.

35. The method of claim 34, wherein using a repetitive controller in a secondary control loop comprises:

using said error signal to produce a repetitive command signal that is added to said error signal, wherein said produced control signal to said motor incorporates said repetitive command signal.

36. The method of claim 33, wherein said primary control loop incorporates a model of the human visual system.

37. The method of claim 36, wherein said model of the human visual system is the human contrast sensitivity function modified to have a low-pass filter profile and to be in temperal frequency.

38. A method of designing a repetitive controller in a secondary loop for an electrophotographic device to reduce banding artifacts, said method comprising:

modeling a closed loop transfer function for an electrophotographic device; and synthesizing the repetitive controller transfer function using:

$$G_c(z) = k_r \frac{R(z^{-1})z^{-N}}{S(z^{-1})1 - z^{-N}}$$

where $0<k_r<2$ $R(z^{-1})=k_r z^d A(z^{-1})B^{-1}(z)$ $B^-(z)$=Replace $z^{-1}$ in $B^-(z^{-1})$ with $z$ $S(z^{-1})=B^+(z^{-1})b$ $b \geqq \max|B^-(e^{-jw})|^2,\ w \epsilon [0,\pi].$

39. The method of claim 38, wherein modeling a closed loop transfer function comprises:

determining a closed loop controller;

producing the frequency response of said electrophotographic device with said closed loop controller; and mathematically describing said frequency response.

* * * * *

UNITED STATES PATENT AND TRADEMARK OFFICE

CERTIFICATE OF CORRECTION

PATENT NO. : 6,456,808 B1
DATED : September 24, 2002
INVENTOR(S) : Chen et al.

It is certified that error appears in the above-identified patent and that said Letters Patent is hereby corrected as shown below:

Column 17,
Line 28, “dram” should read -- drum --.

Signed and Sealed this

Eleventh Day of November, 2003

JAMES E. ROGAN
*Director of the United States Patent and Trademark Office*